US007367733B2

(12) United States Patent
Bedzyk et al.

(10) Patent No.: US 7,367,733 B2
(45) Date of Patent: May 6, 2008

(54) ACTUATED PRESSURE ROLLER IN MEDIA TRANSPORT

(75) Inventors: Mark D. Bedzyk, Pittsford, NY (US); Jeffrey R. Hawver, Marion, NY (US)

(73) Assignee: Carestream Health, Inc., Rochester, NY (US)

( * ) Notice: Subject to any disclaimer, the term of this patent is extended or adjusted under 35 U.S.C. 154(b) by 347 days.

(21) Appl. No.: 11/069,416

(22) Filed: Mar. 1, 2005

(65) Prior Publication Data

US 2006/0197817 A1 Sep. 7, 2006

(51) Int. Cl.
*B41J 11/58* (2006.01)
*B41J 13/10* (2006.01)

(52) U.S. Cl. ..... 400/625; 400/624; 400/636; 347/104

(58) Field of Classification Search ..... 400/624–625, 400/629, 636–637, 639; 271/272–274
See application file for complete search history.

(56) References Cited

U.S. PATENT DOCUMENTS 6,343,787 B1 * 2/2002 Kato et al. ..... 271/274
6,505,833 B2 * 1/2003 Kato et al. ..... 271/272
6,526,239 B2 2/2003 Shiiya

FOREIGN PATENT DOCUMENTS

WO 2003/086921 * 10/2003

* cited by examiner

*Primary Examiner*—Daniel J. Colilla
*Assistant Examiner*—Marissa Ferguson-Samreth

(57) ABSTRACT

An apparatus for transporting a sheet recording medium (12) has an entrance drive roller (16) paired with a corresponding entrance pressure roller (18) to form an entrance nip (14) for transporting the sheet recording medium (12) into a scanning section (20) between the entrance nip (14) and an exit nip (24). The exit nip (24) is formed by an exit drive roller (26) with a corresponding exit pressure roller (28) for transporting the recording medium (12) out from the scanning section (20). At each end of the entrance pressure roller (18), an entrance pressure roller actuation arm (120) actuates the entrance pressure roller (18) to exert variable force against the entrance drive roller (16). At each end of the exit pressure roller (28), an exit pressure roller actuation arm (130) actuates the exit pressure roller (28) to exert variable force against the exit drive roller (26).

28 Claims, 22 Drawing Sheets

ACTUATED PRESSURE ROLLER IN MEDIA TRANSPORT

CROSS REFERENCE TO RELATED APPLICATIONS

Reference is made to commonly-assigned copending U.S. patent application Ser. No. 10/977,841, filed Oct. 29, 2004, entitled SHEET RECORDING APPARATUS WITH DUAL NIP TRANSPORT, by Hawver et al.; and U.S. patent application Ser. No. 11/035,037, filed Jan. 13, 2005, entitled PINION ROLLER DRIVE FOR RECORDING APPARATUS, by Bedzyk et al., the disclosures of which are incorporated herein.

FIELD OF THE INVENTION

This invention generally relates to sheet media transport apparatus and more particularly relates to an image recording apparatus with a precision media transport apparatus that uses an actuated pressure roller mechanism for providing controlled nip pressure on the media.

BACKGROUND OF THE INVENTION

Nip-fed sheet media transport systems using paired rollers are widely used in various printing applications. In a nip-fed system, a drive roller is pressed against a backing roller to form a nip and provides drive motion at the nip. A nip-fed transport can be engineered to perform with a suitable degree of accuracy in devices such as printers and office copiers. However, conventional nip-fed media transport mechanisms do not provide sufficient precision for imaging applications that require high resolution. For example, many types of medical imaging apparatus print onto a sheet of recording medium at resolutions well exceeding 600 dots per inch. For such devices, a sheet media transport must provide extremely accurate motion when moving the sheet through the image recording mechanism. This problem becomes even more pronounced with full-sheet imaging, in which little or no margin is to be provided at the leading or trailing edges of a sheet. As is well appreciated by those skilled in media transport arts, the dynamics of handling and urging a sheet of recording medium through a printing mechanism can be much more complex at the leading and trailing edges that along more central portions of the sheet.

Dual nip apparatus provide advantages where it is necessary to provide more precise motion control for sheet media. By using two pairs of rollers in series along the transport path, a more stable sheet media transport is provided, since the motion of the medium is controlled through at least one nip at any point during the image recording process. FIG. 1 shows, in schematic form, a conventional dual nip transport apparatus 10 as used for a sheet of recording medium 12. In the travel path, recording medium 12 is fed through an entrance nip 14 formed between an entrance drive roller 16 and a pressure roller 18, then through an exit nip 24 formed between an exit drive roller 26 and a pressure roller 28. Image data is recorded by a printhead 56, or other type of write head or recording head, that records the image onto recording medium 12 as it is progressively scanned through an imaging area 20 between entrance nip 14 and exit nip 24. Typically printhead 56 is a scanned point source, such as a laser or other source of electromagnetic radiation, that is scanned across recording medium 12 in a direction orthogonal to the direction of motion Q. In order to provide uniform speed with dual nip media transport apparatus 10, it is necessary to couple the speed of entrance drive roller 16 at entrance nip 14 with the speed of exit drive roller 26 at exit nip 24. The conventional method for coupling rotation of entrance and exit drive rollers 16 and 26 is using a belt 22, as shown in FIG. 1.

Dual nip transport devices such as dual nip transport apparatus 10 in FIG. 1 perform sufficiently well for many types of imaging applications. However, dual nip transport arrangements using conventional design approaches fall somewhat short of performance levels needed for high-resolution medical imaging applications. One notable type of problem relates to transitions as the sheet medium moves through the entrance and exit nips, particularly at leading and trailing edges of a sheet. At certain points in the transport cycle, the sheet medium goes through a transition between being held in one nip and being held in both nips. As the sheet edge enters or exits a nip, any abruptness in handling can cause a corresponding effect on the image recording operation.

Thus, it can be seen that there is a need for a transport mechanism that provides precision handling of single sheet media at a constant transport speed, allowing full sheet scanning and imaging from leading to trailing edge and minimizing the effects of transitions at leading and trailing edges.

SUMMARY OF THE INVENTION

It is an object of the present invention to provide a sheet media transport apparatus capable of improved precision. With this object in mind, the present invention provides an apparatus for transporting a sheet medium, comprising:

an entrance drive roller paired with a corresponding entrance pressure roller to form an entrance nip for transporting the sheet medium into a scanning section between the entrance nip and an exit nip;

the exit nip formed by an exit drive roller paired with a corresponding exit pressure roller for transporting the sheet medium out from the scanning section;

wherein, at each end of the entrance pressure roller, an entrance pressure roller actuation arm, actuated by a rotatable entrance roller cam, actuates the entrance pressure roller to exert a variable force against the entrance drive roller; and wherein, at each end of the exit pressure roller, an exit pressure roller actuation arm, actuated by a rotatable exit roller cam, actuates the exit pressure roller to exert a variable force against the exit drive roller.

From another aspect, the present invention provides an apparatus for recording an image onto a sheet medium, comprising:

a) an entrance drive roller paired with a corresponding entrance pressure roller to form an entrance nip for transporting the sheet medium into an image recording section;

b) the image recording section comprising a write head for recording onto a portion of the sheet medium being transported between the entrance nip and an exit nip;

c) the exit nip formed by an exit drive roller paired with a corresponding exit pressure roller for transporting the sheet medium out from the image recording section;

wherein, at each end of the entrance pressure roller, an entrance pressure roller actuation arm, actuated by a rotatable entrance roller cam, actuates the entrance pressure roller to exert a variable force against the entrance drive roller; and wherein, at each end of the exit pressure roller, an exit pressure roller actuation arm, actuated by a rotatable exit roller cam, actuates the exit pressure roller to exert a variable force against the exit drive roller.

It is a feature of the present invention that it employs a mechanism for coordinating the engagement and disengagement of paired pressure rollers for obtaining smooth media movement.

It is an advantage of the present invention that it helps to enable imaging onto a full sheet of sensitized medium.

It is a further advantage of the present invention that it allows transport of the medium through the imaging area and minimizes abrupt changes to media movement between leading and trailing edges.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

Figure 1:
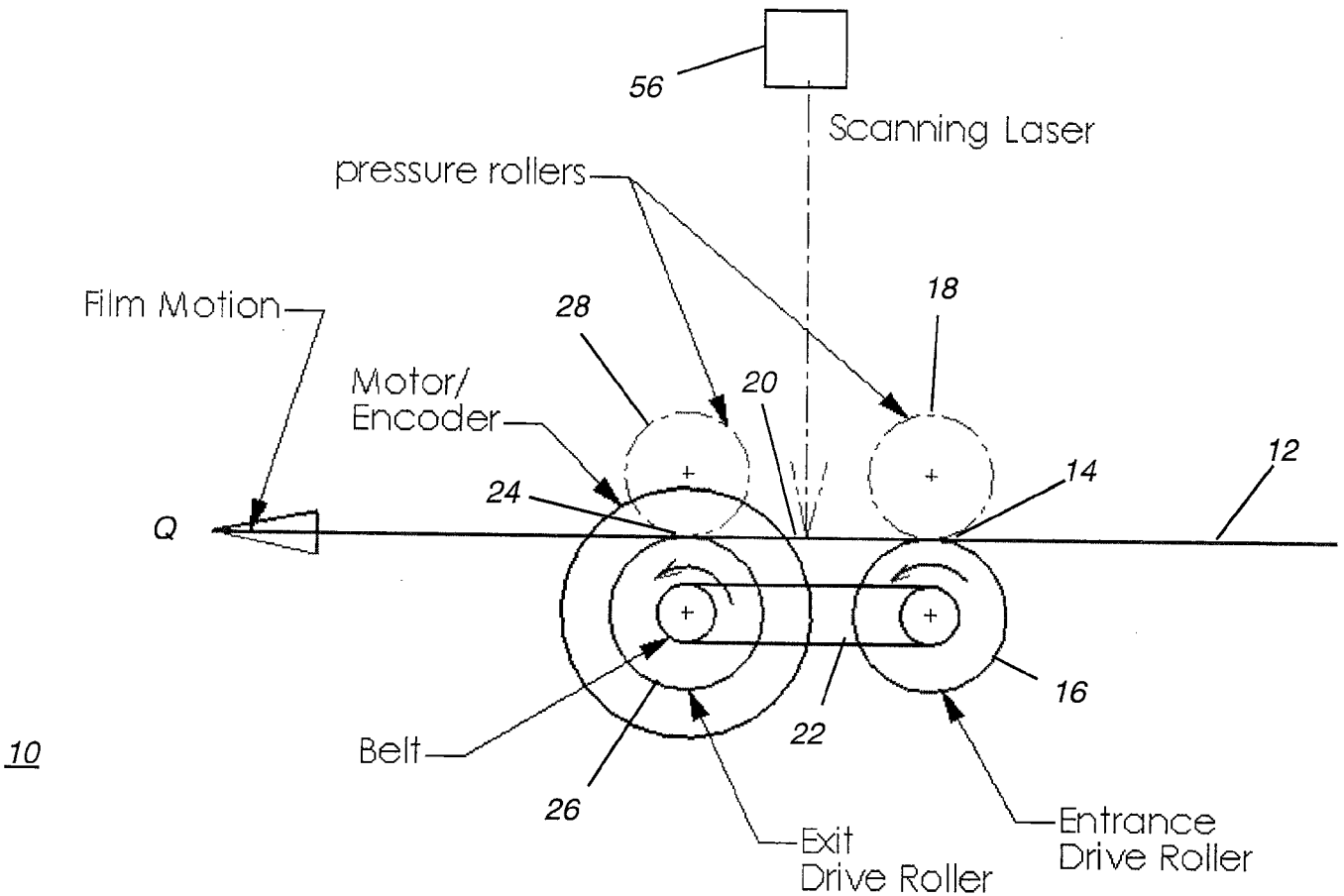
FIG. 1 PRIOR ART
FIG. 1 is a schematic diagram showing a conventional dual nip media transport apparatus.
Figure 2:
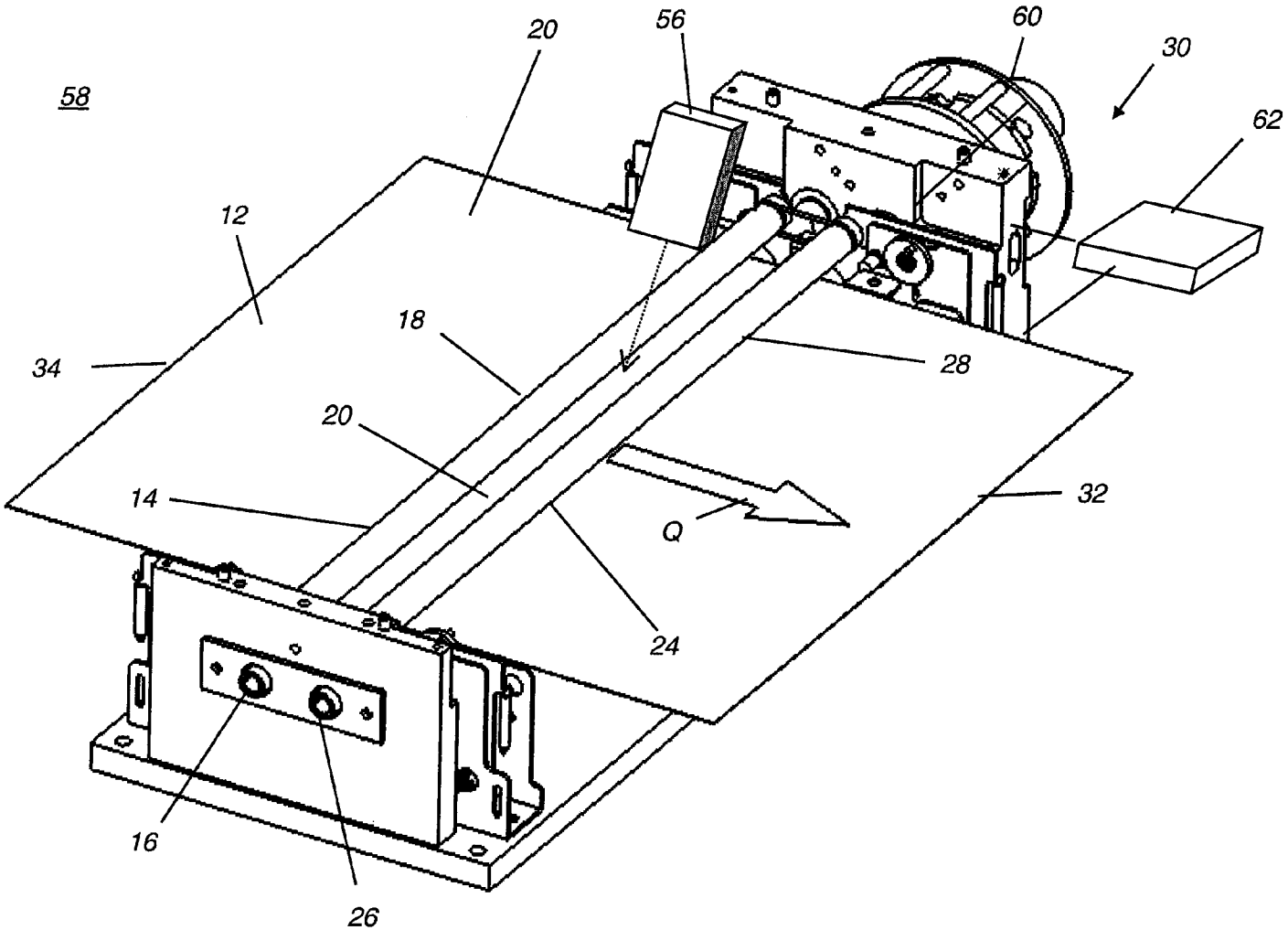
FIG. 2 is a perspective view of an apparatus for image recording, using an actuated dual nip media transport according to the present invention.

Referring to FIG. 2, there is shown an image recording apparatus 58 for full sheet imaging, utilizing a dual nip media transport apparatus 30 according to an embodiment of the present invention. A sheet of recording medium 12, transported in direction Q, has a leading edge 32 and a trailing edge 34. Pressure rollers 18 and 28 cooperate with corresponding entrance and exit drive rollers 16 and 26 to form entrance nip 14 and exit nip 24, respectively. In the embodiment shown, a motor 60 is coupled to exit drive roller 26.

Imaging area 20 for image scanning is in a widthwise strip of recording medium 12 between entrance and exit nips 14 and 24. Printhead 56 directs exposure energy from a laser or other point or linear electromagnetic energy source, in a scanned fashion, onto that portion of recording medium 12 that is within imaging area 20. A control logic processor 62 controls the flow of image data to printhead 56, controls operation of motor 60, which may be provided with an encoder, and controls other internal and interface functions of image recording apparatus, using components, algorithms, and techniques familiar to those skilled in the electronic imaging arts.

Figure 3A:
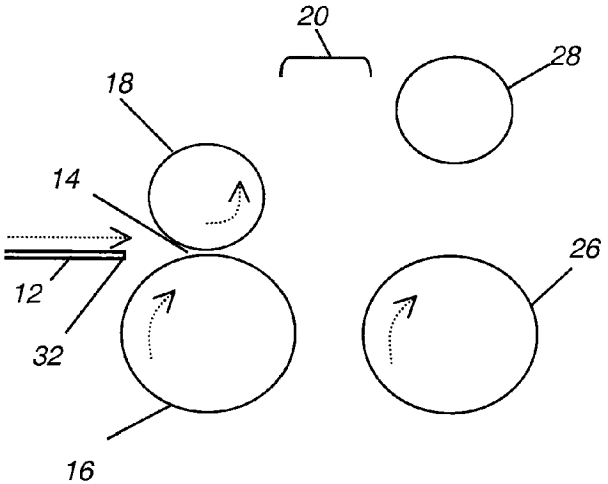
FIGS. 3A-3H are schematic diagrams showing the basic sequence of roller actuation relative to the position of leading and trailing edges of the recording medium during a complete imaging sequence.

As noted in the background section above, abrupt transitions of recording medium 12 in transit between entrance and exit nips 14 and 24 are undesirable. To provide smooth transitions in handling leading and trailing edges 32 and 34 of recording medium 12, dual nip transport apparatus 10 of the present invention provides a sequence of pressure roller 18 and 28 actuations that engages and disengages these rollers with variable force, based on how much pressure is best suited at each point in transit. Referring to FIGS. 3A-3H, there are shown, exaggerated for emphasis, the various states of pressure roller 18 and 28 engagement during transit of recording medium 12, shown moving progressively left to right in this sequence. FIG. 3A shows the state of roller engagement before recording medium 12 reaches entrance nip 14. Pressure roller 18 is already engaged against entrance drive roller 16. Pressure roller 28, meanwhile, is lifted up from exit roller 26 and remains up when leading edge 32 reaches entrance nip 14. Pressure roller 28 begins its descent toward exit roller 26 when leading edge 32 is somewhat past imaging area 20, as shown in FIG. 3C. Both pressure rollers 18 and 28 are engaged after the arrival of leading edge 32 at exit nip 24, shown in FIG. 3D, to some time before the arrival of trailing edge 34 at entrance nip 14, shown in FIG. 3E. As FIG. 3F shows, pressure roller 18 is disengaged as trailing edge 34 moves into image area 20. Pressure roller 28 remains engaged until trailing edge 34 is released from exit nip 24, as shown in FIGS. 3G and 3H.

The apparatus and method of the present invention provide a dual nip transport that handles recording medium 12 in the sequence shown in FIGS. 3A-3H. Unlike conventional pressure roller arrangements, however, the apparatus and method of the present invention are particularly well suited to handling recording medium 12 within imaging area 20. In order to provide a smooth transition, the apparatus of the present invention actuates pressure rollers 18 and 28 to engage/disengage with their corresponding entrance and exit rollers 16 and 26 with gradual changes in pressure, thereby gradually increasing or decreasing the overall pressure at entrance and exit nips 14 and 24.

Figure 8B:
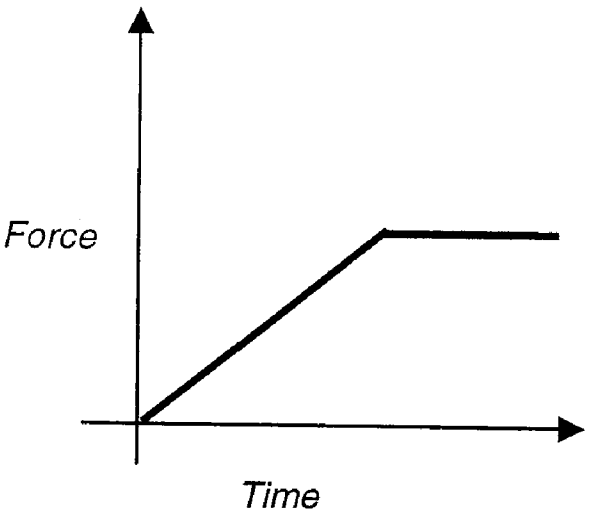
FIGS. 8A and 8B are idealized graphs of force versus time for abrupt "clamping" action and desired gradual application of force, respectively, for leading edge handling.
Figure 8A:
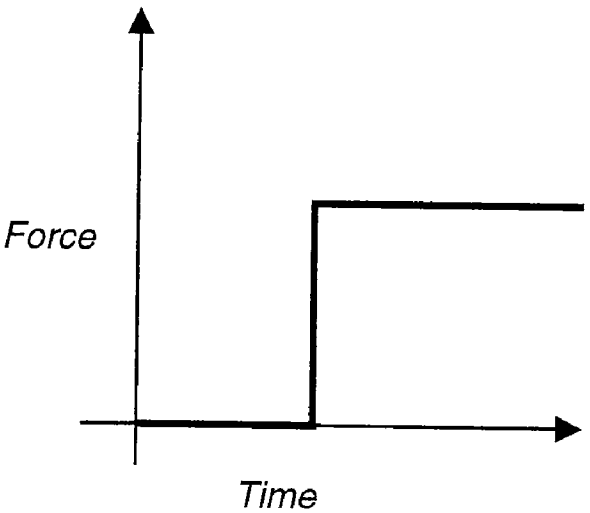
Figure 9B:
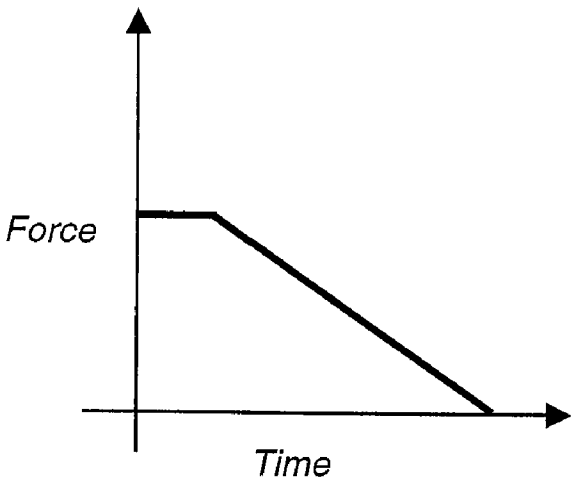
FIGS. 9A and 9B are idealized graphs of force versus time for abrupt "unclamping" action and desired gradual removal of force, respectively, for trailing edge handling.
Figure 9A:
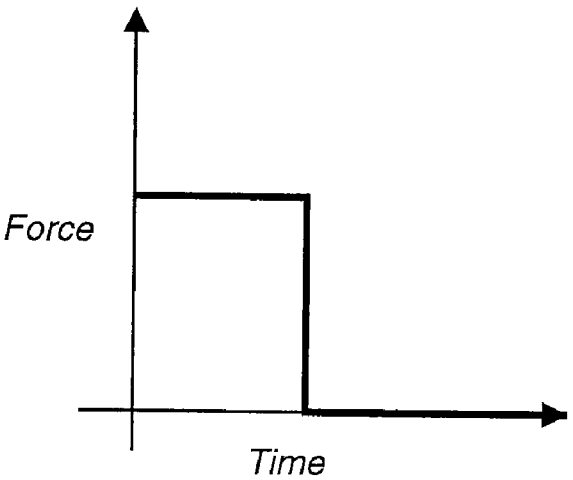

FIG. 8A shows a graph of force versus time when an abrupt "clamping" action is provided for exit pressure roller 28. The abrupt change in force results in a disturbance impulse that can result in an image defect due to gripping by the rollers. For comparison, FIG. 8B shows the force versus time characteristic when applying the graduated pressure change to exit nip 24 described with reference to the sequence of FIGS. 3A-3H. Similarly, for releasing entrance pressure roller 18, FIGS. 9A and 9B show graphs of force versus time without and with the gradual changes in pressure provided by the present invention. It is instructive to note that this same gradual application and releasing of force can be used at both entrance nip 14 and exit nip 24.

Figure 3B:
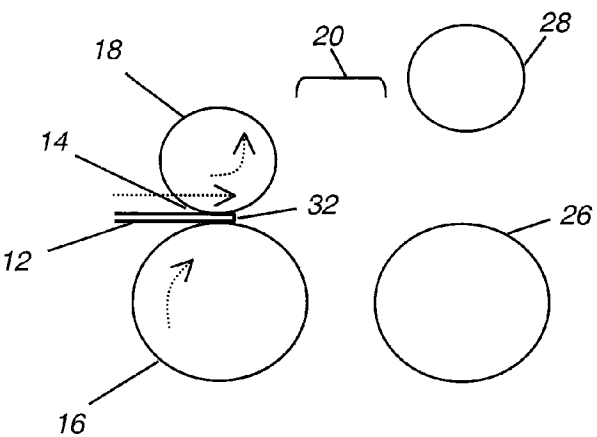
Figure 3C:
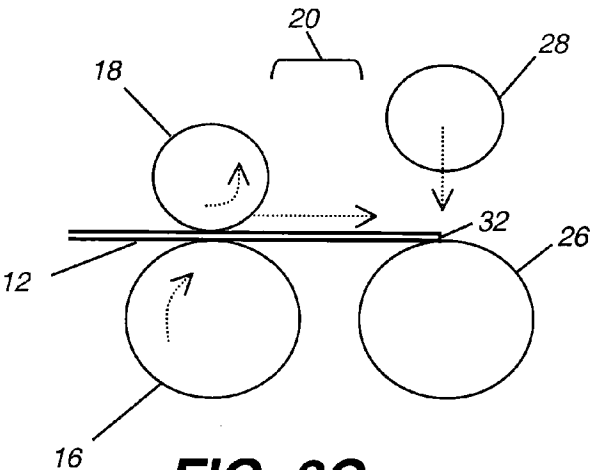
Figure 3D:
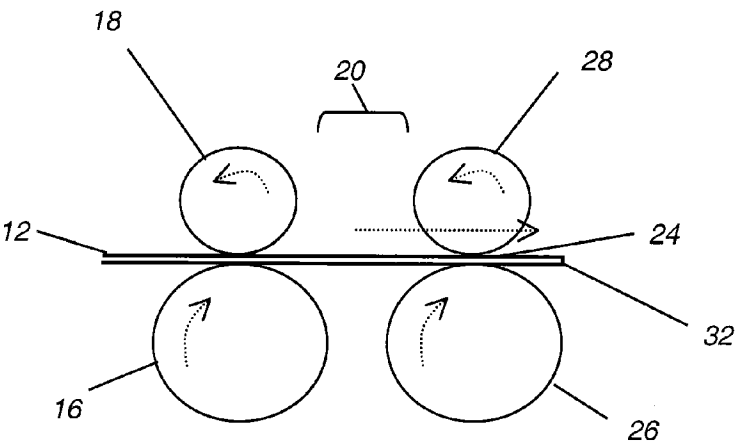
Figure 3F:
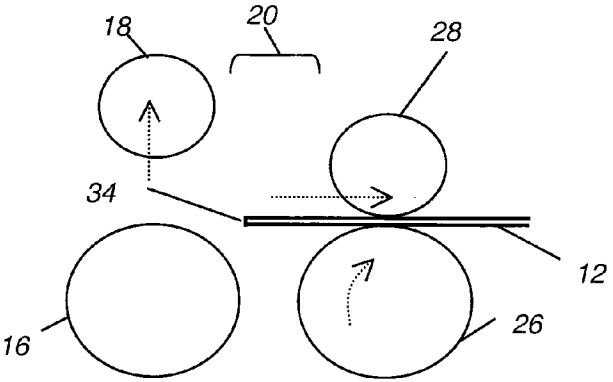
Figure 3H:
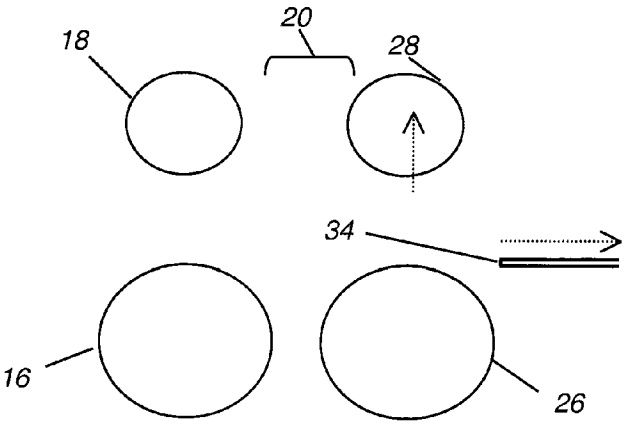

It can be observed that, in the preferred embodiment, gradual change in engagement pressure is not required at entrance nip 14 (FIGS. 3A, 3B). This is because there is no section of recording medium 12 being imaged when leading edge 32 arrives at entrance nip 14. However, maintaining the "soft landing" of exit pressure roller 28 (FIGS. 3C, 3D) is important for minimizing abrupt movement of recording medium 12. In this "soft landing", exit pressure roller 28 presses against exit drive roller 26 with a gradually increasing pressure along exit nip 24.

Figure 3E:
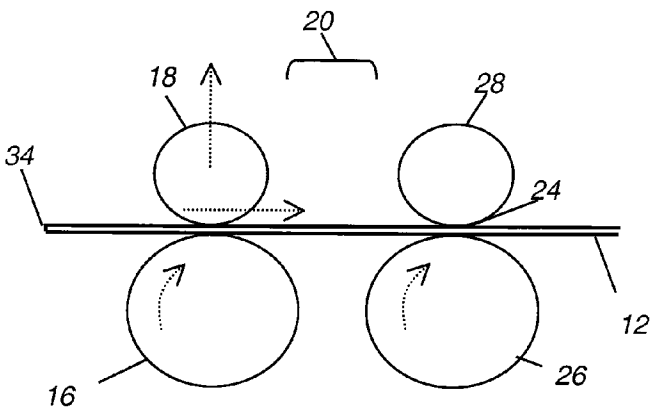
Figure 3G:
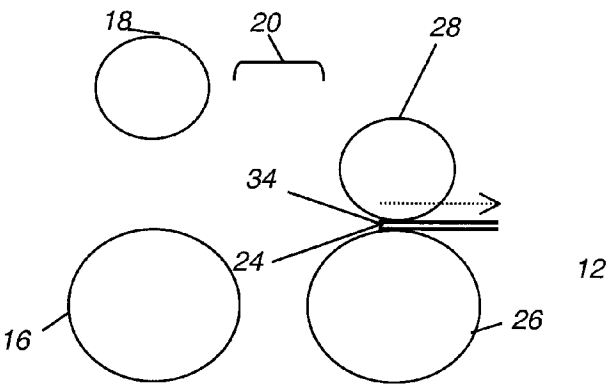

Similarly, a "soft liftoff" of entrance pressure roller 18 is needed to minimize abruptness near the end of the sheet of recording medium 12 (FIGS. 3E, 3F). As trailing edge 34 nears entrance nip 14, the pressure at entrance nip 14 is gradually released and entrance pressure roller 18 is raised (FIGS. 3E, 3F). Disengagement of exit pressure roller 28, however, does not require gradual release of pressure (FIGS. 3G, 3H). By making gradual transitions in this way, the apparatus of the present invention transports recording medium 12 through imaging area 20 without binding or other abrupt changes in motion.

Cam mechanisms have been used for single-nip roller actuation in sheet media transport apparatus. For example, U.S. Pat. No. 6,526,239 (Shiiya) discloses the use of a spring-loaded cam mechanism for lowering and raising a single heater roller in an electrophotographic fixing unit at appropriate times to prevent scorching of the media by continuous contact. However, the single-nip solution of U.S. Pat. No. 6,526,239 is not readily adaptable to the requirements for dual nip sheet transport in which pressure and opposing rollers cooperate as shown in the sequence of FIGS. 3A-3H, particularly where gradual change in nip pressure are needed for both entrance and exit nips 14 and 24 and where entrance and exit nip 14 and 24 timing relates to the position of leading or trailing edges 32, 34.

Figure 4:
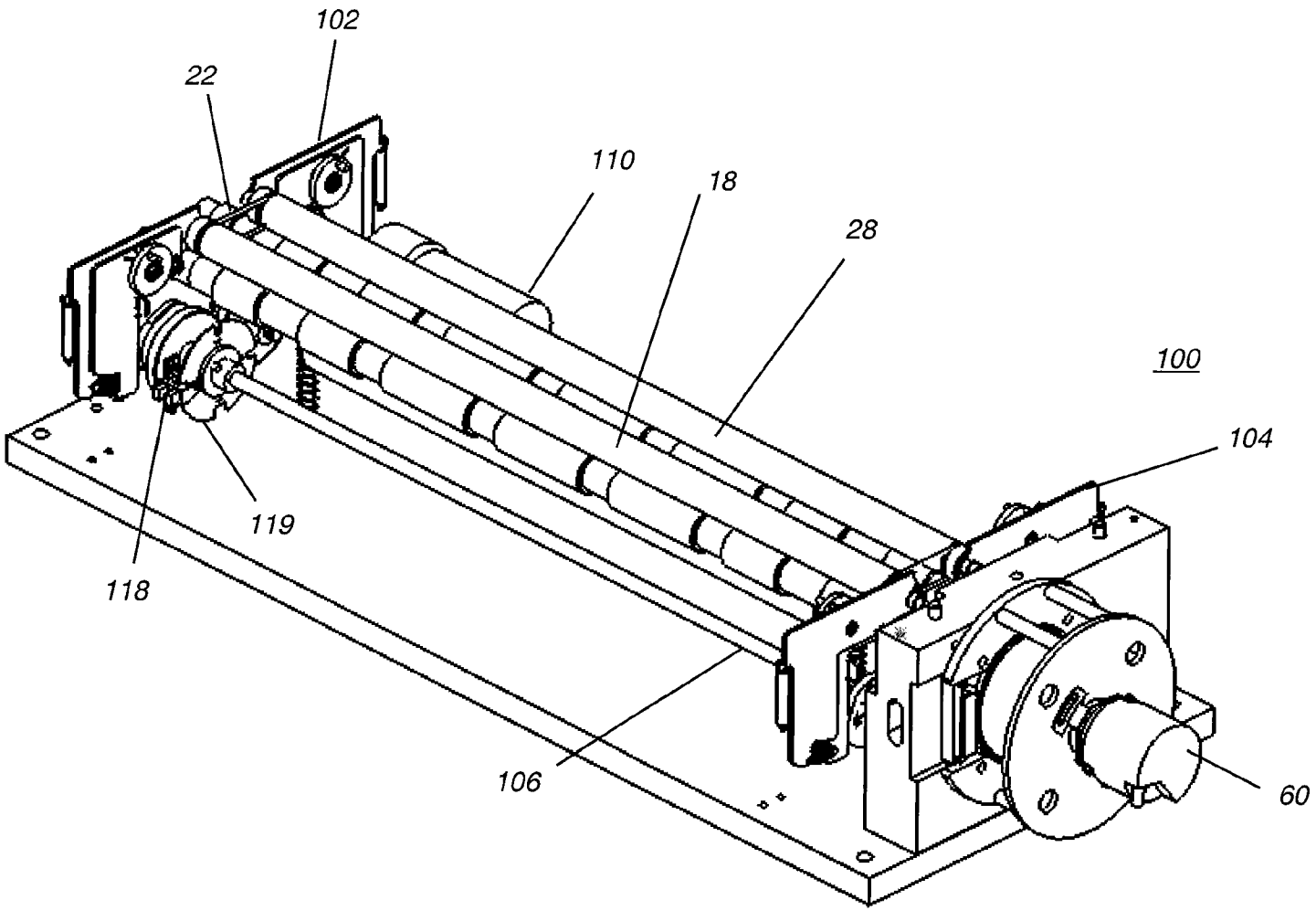
FIG. 4 is a perspective view of a dual nip transport apparatus in one embodiment, with some components removed for clarity.

Referring to FIG. 4, there is shown, separated from other components of image recording apparatus 58 (FIG. 2) a pressure roller actuation assembly 100 according to one embodiment of the present invention. Pressure roller actuation assembly 100 has components for lifting and lowering each end of pressure rollers 18, 28 in a manner synchronized with the motion of sheet of recording medium 12, as was shown in FIGS. 3A-3H. A first bracket assembly 102 supports one end of pressure rollers 18, 28 and a second bracket assembly 104 supports the opposite end. Similar components are deployed within each bracket assembly 102, 104 for raising and lowering pressure rollers 18, 28. Cam shafts 106, 108 (108 not visible at the perspective angle of FIG. 4, but shown in FIG. 6A) join moving components for controlling pressure roller 18, 28 actuation within each bracket assembly 102, 104, described subsequently. A motor 110 provides the drive energy needed to actuate pressure roller actuation assembly 100. A sensor 118 provides feedback information on cam shaft 106 rotation by sensing position of a detector wheel 119.

Figure 6A:
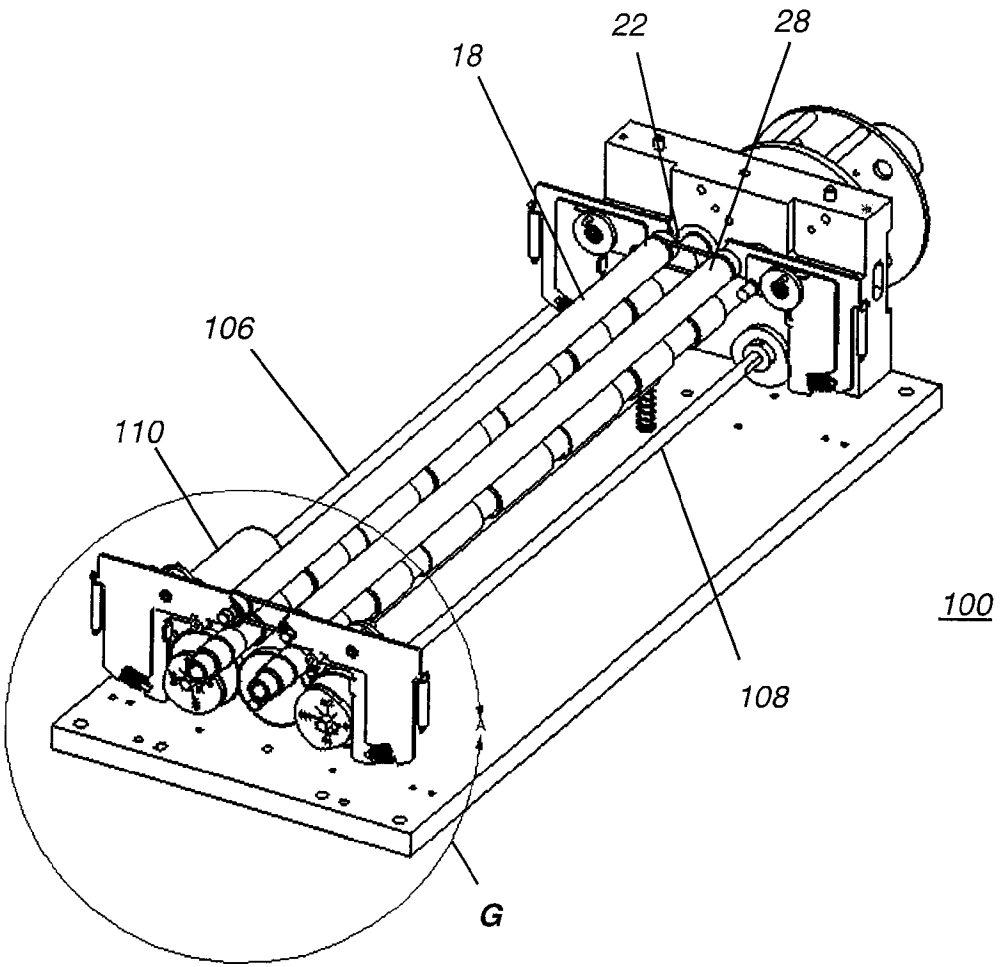
FIG. 6A is a perspective view of a dual nip transport apparatus according to one embodiment.
Figure 6B:
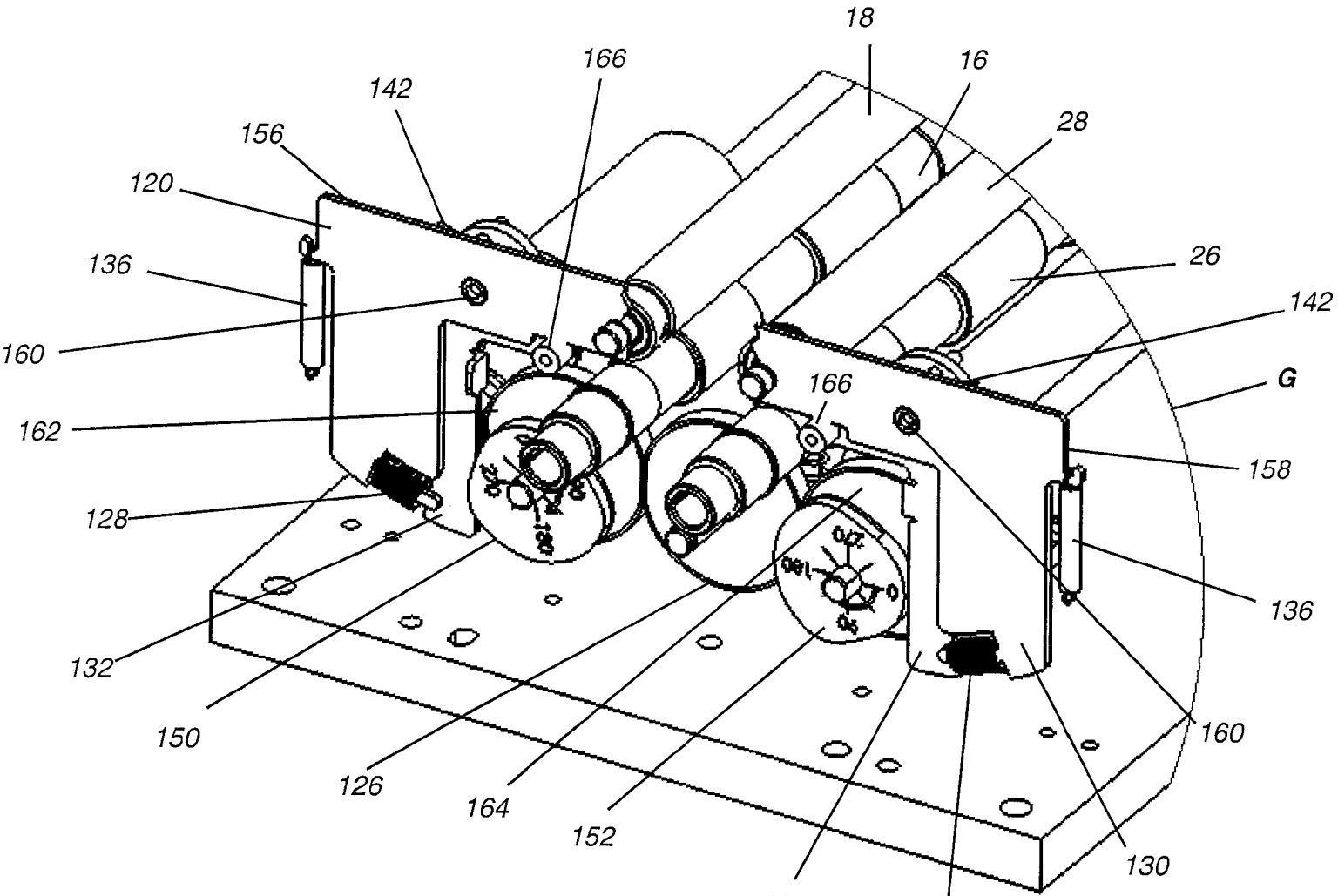
FIG. 6B is a close-up perspective view of dual nip transport components at one end of the rollers.

Referring to FIG. 6A, there is shown a perspective view of pressure roller actuation assembly 100 in one embodiment, from a different viewing angle than that used for FIG. 4. Area G is shown enlarged in FIG. 6B. Coupling gear 126 couples motion of gears 162, 164, connected to cams 150 and 152 respectively. Actuation arms 120 and 130, comprising roller links 156, 158 pivoted against cam follower links 132, 134 on pivots 160, are coupled to cams 150, 152 respectively, each loaded against cam follower link 132, 134 by compression springs 128, 138 and torsion springs 142 (partially hidden in the view of FIG. 6B). Cam follower links 132, 134, in turn, actuate roller links 156, 158 of actuation arms 120, 130 at link pins 166. Pivot 160 allows pivoting movement of each of roller links 156, 158 to lift and lower pressure rollers 18 and 28 respectively. Extension springs 136 each provide a counter-balancing force to offset gravity for pressure rollers 18 and 28.

The action of actuation arms 120 and 130 for each media transport stage is best shown in the sequence of FIGS. 7A-7K. In each of FIGS. 7A-7K, both front views (corresponding to FIG. 6B) and rear views of this mechanism are shown. For the sequence of FIGS. 7A-7K, the actuation timing is controlled by control logic processor 62, as was shown in FIG. 2. As was shown in FIG. 4, sensor 118 and detector wheel 119 provide feedback information that enables control logic processor to start and stop motor 110 as needed. Leading and trailing edges 32 and 34 of recording medium 12 may be sensed by some other mechanism or may be calculated according to a standard length of medium 12 supplied to dual nip apparatus 10 in image recording apparatus 58 (FIG. 2).

Figure 7A:
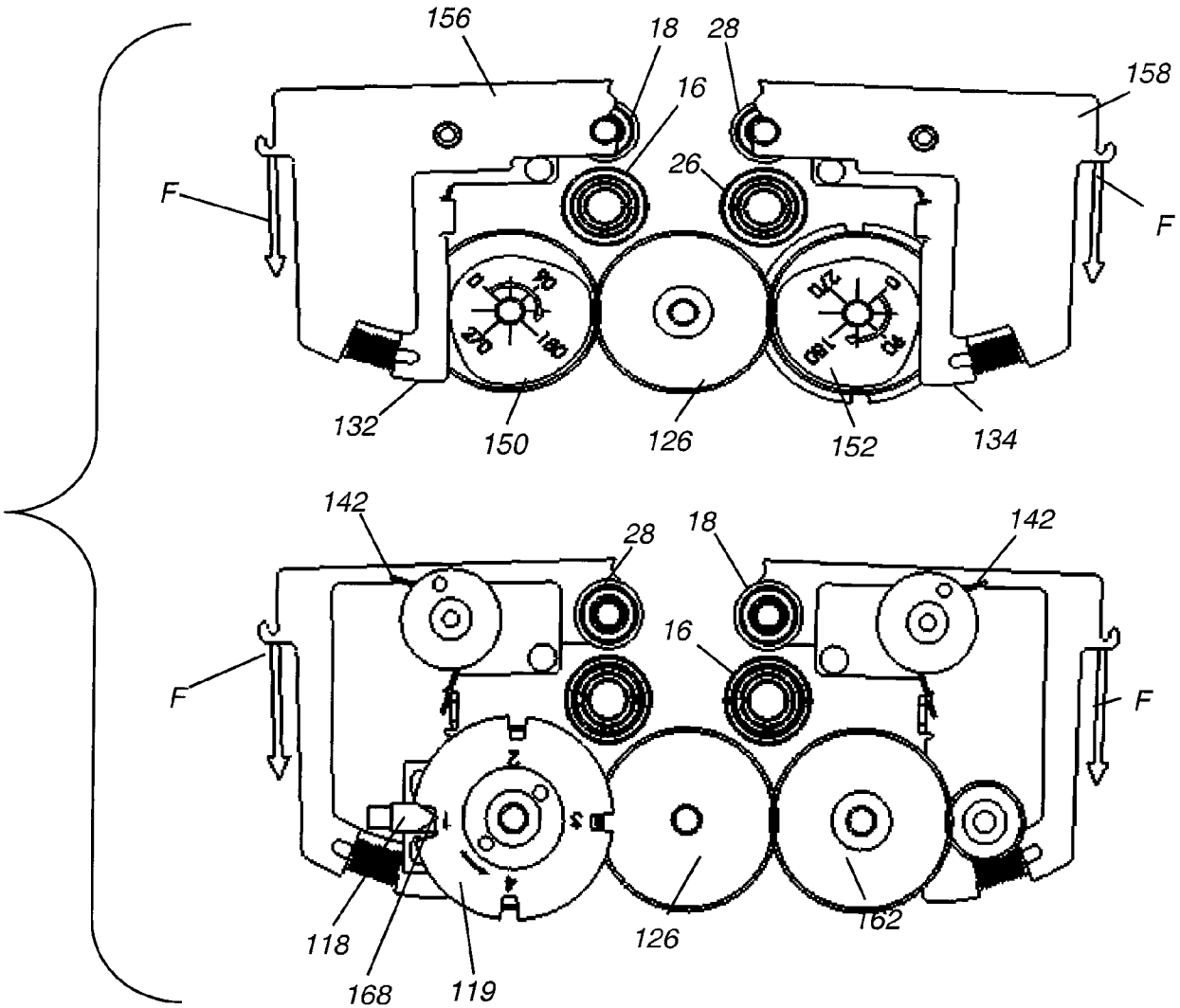
FIGS. 7A-7K are plan views, from both inside and outside positions, of a dual nip transport apparatus, showing the actuation sequence for engagement and disengagement of rollers.

FIG. 7A shows a home position, with both pressure rollers 18 and 28 disengaged. Downward force on springs 136 is indicated by arrows F in FIGS. 7A-7K. At the home position of FIG. 7A, cam follower links 132, 134 are forced against cams 150, 152 at a low, or dwell point, loaded by torsion springs 142. Detector wheel 119 indicates home position with a notch 168 at "1".

Figure 7B:
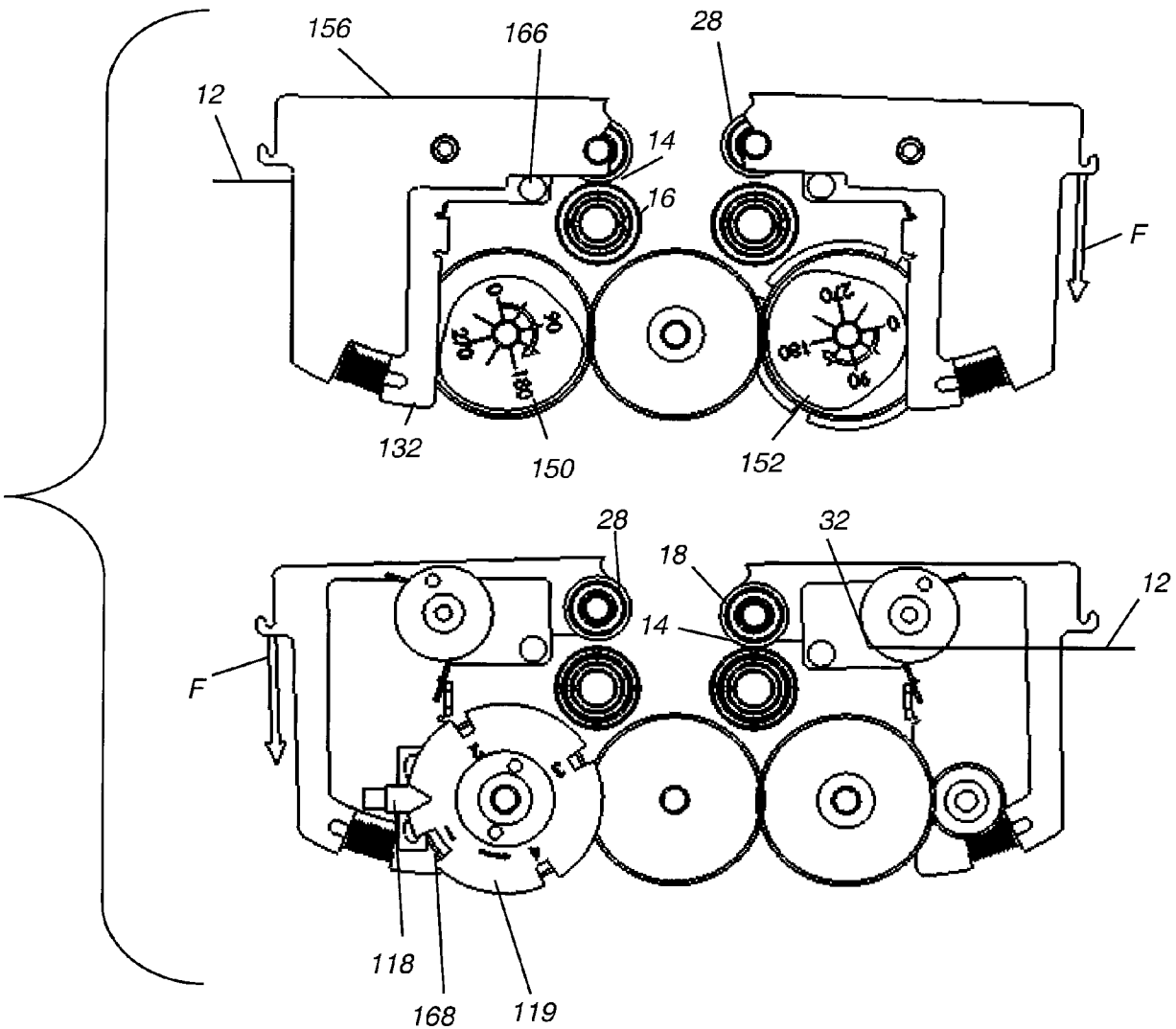

FIG. 7B shows the mechanism as leading edge 32 approaches entrance nip 14. Cams 150, 152 begin to rotate, so that cam follower link 132, releasing pressure from link pin 166, drops roller link 156 to drive pressure roller 18 downwards. Exit pressure roller 28 remains in raised, or disengaged, position. Detector wheel 119 rotates out of the "1" position of FIG. 7A.

Figure 7C:
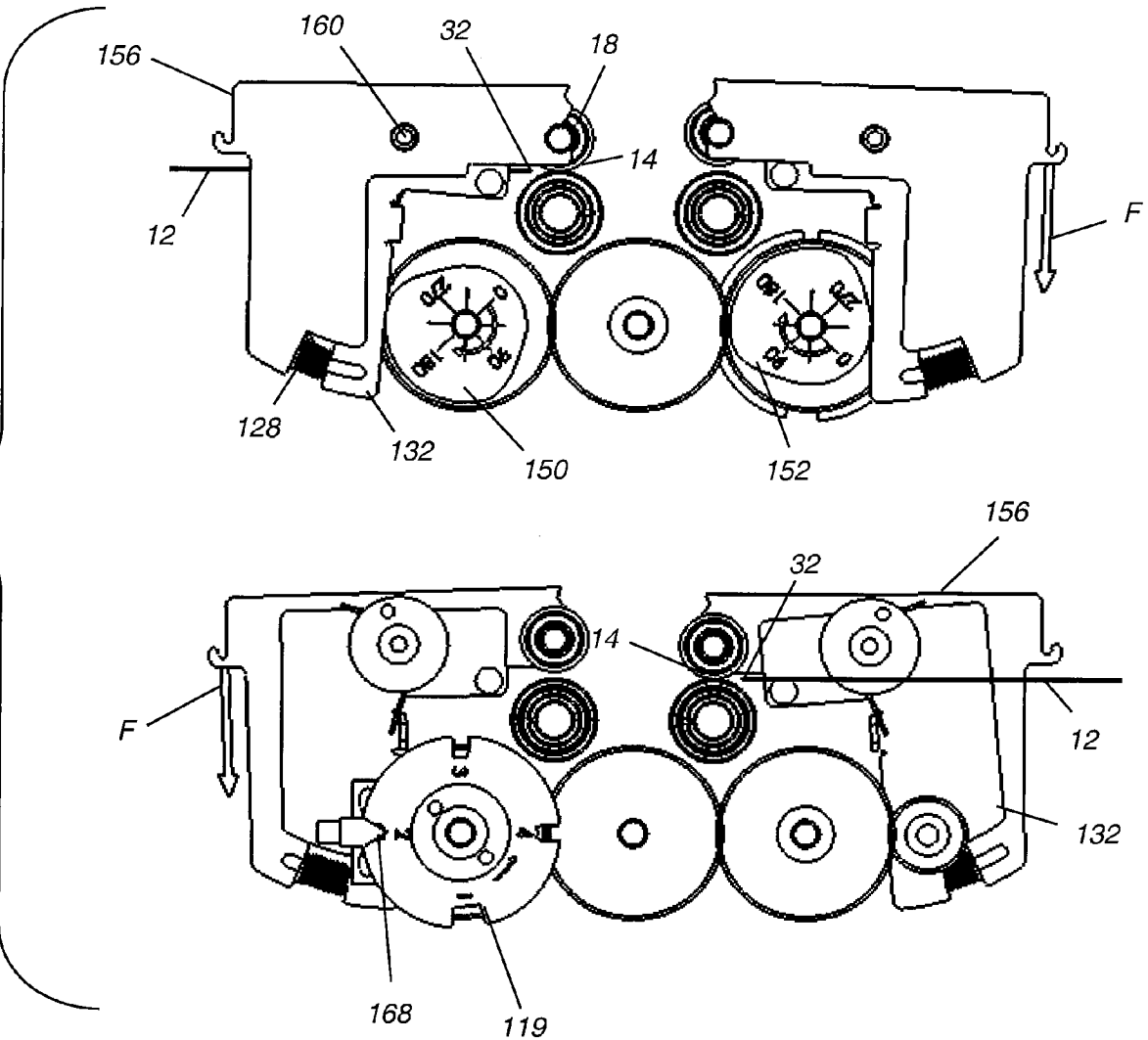

FIG. 7C shows full engagement of pressure roller 18 at entrance nip 14 as leading edge 32 of recording medium 12 is near, but not yet into, entrance nip 14. Compression spring 128 is fully compressed, so that roller link 156 presses downward. In a typical embodiment, compression spring 128 applies about 1-2 pounds of pressure; due to leverage at pivot 160, the applied pressure at nip 14 is approximately twice this pressure. Detector wheel 119 is at notch 168 numbered "2". Exit pressure roller 28 remains in raised, or disengaged, position.

Figure 7D:
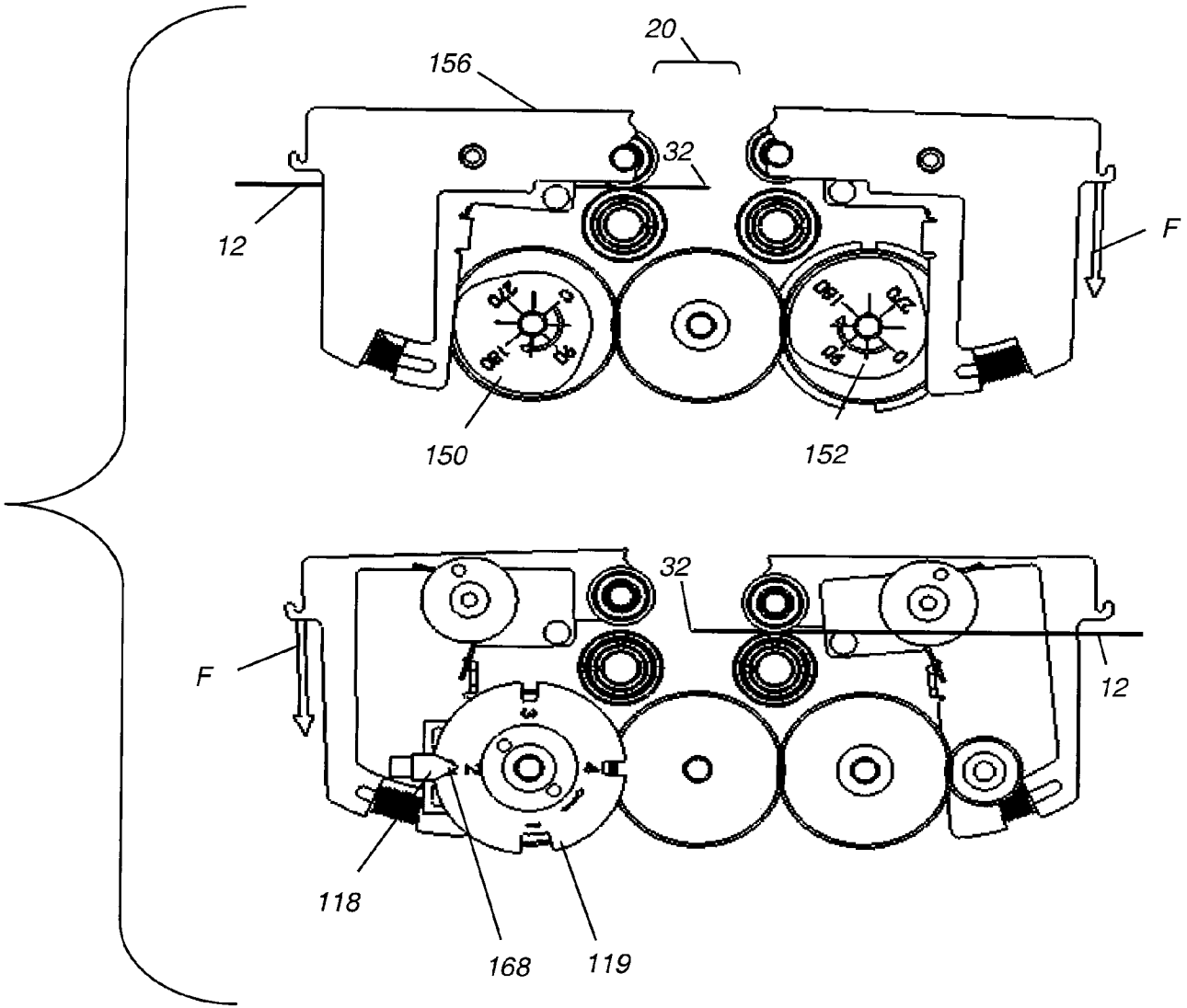

FIG. 7D shows the state of this mechanism as printing over imaging area 20 begins. There is no movement of cams 150, 152; motor 110 is temporarily stopped with detector wheel 119 at notch 168 numbered "2". Exit pressure roller 28 remains in raised, or disengaged, position.

Figure 7E:
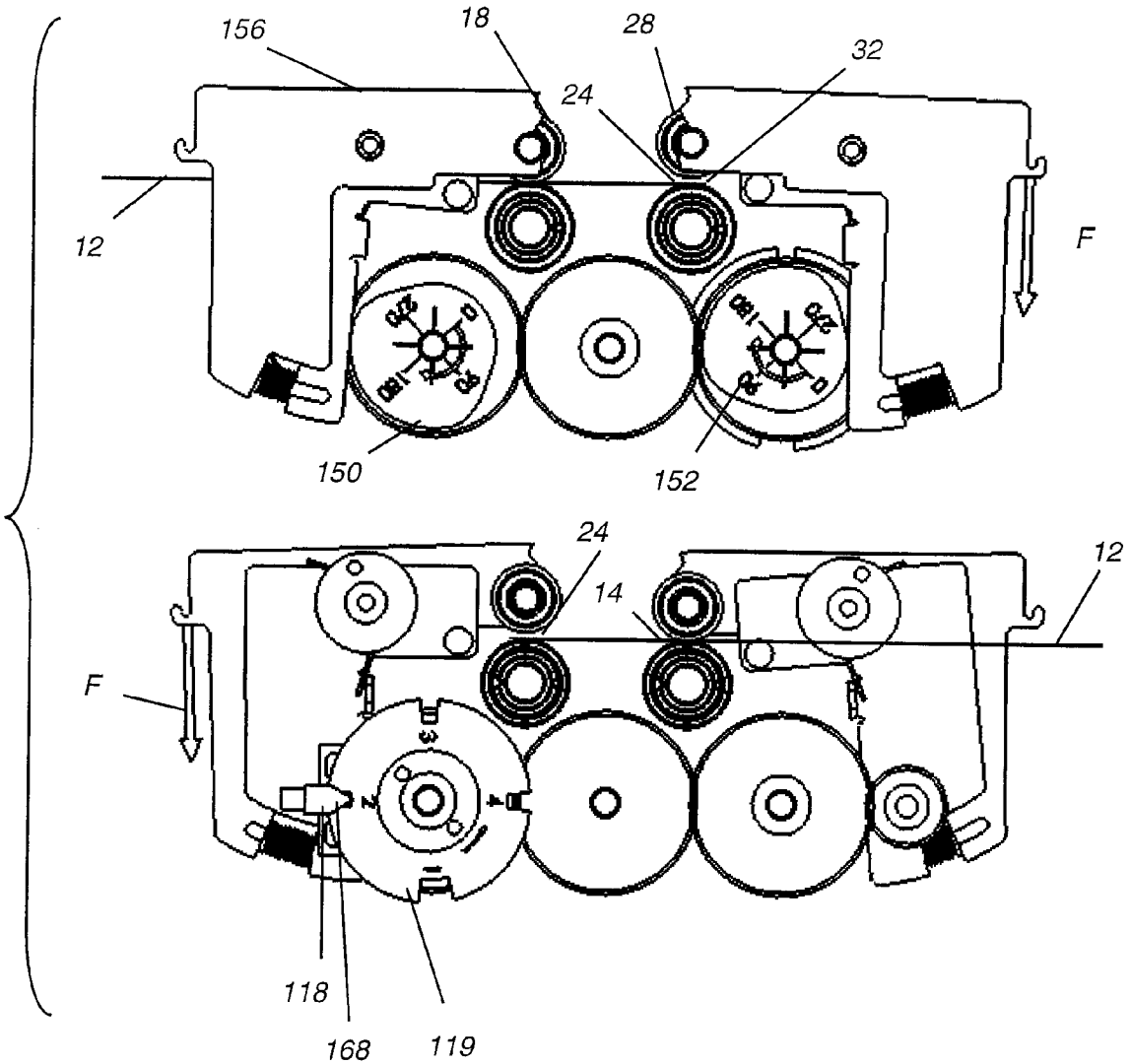

FIG. 7E shows the state of this mechanism as leading edge 32 enters open exit nip 24. There is no rotation of cams 150, 152. Exit pressure roller 28 remains in raised, or disengaged, position.

Figure 7F:
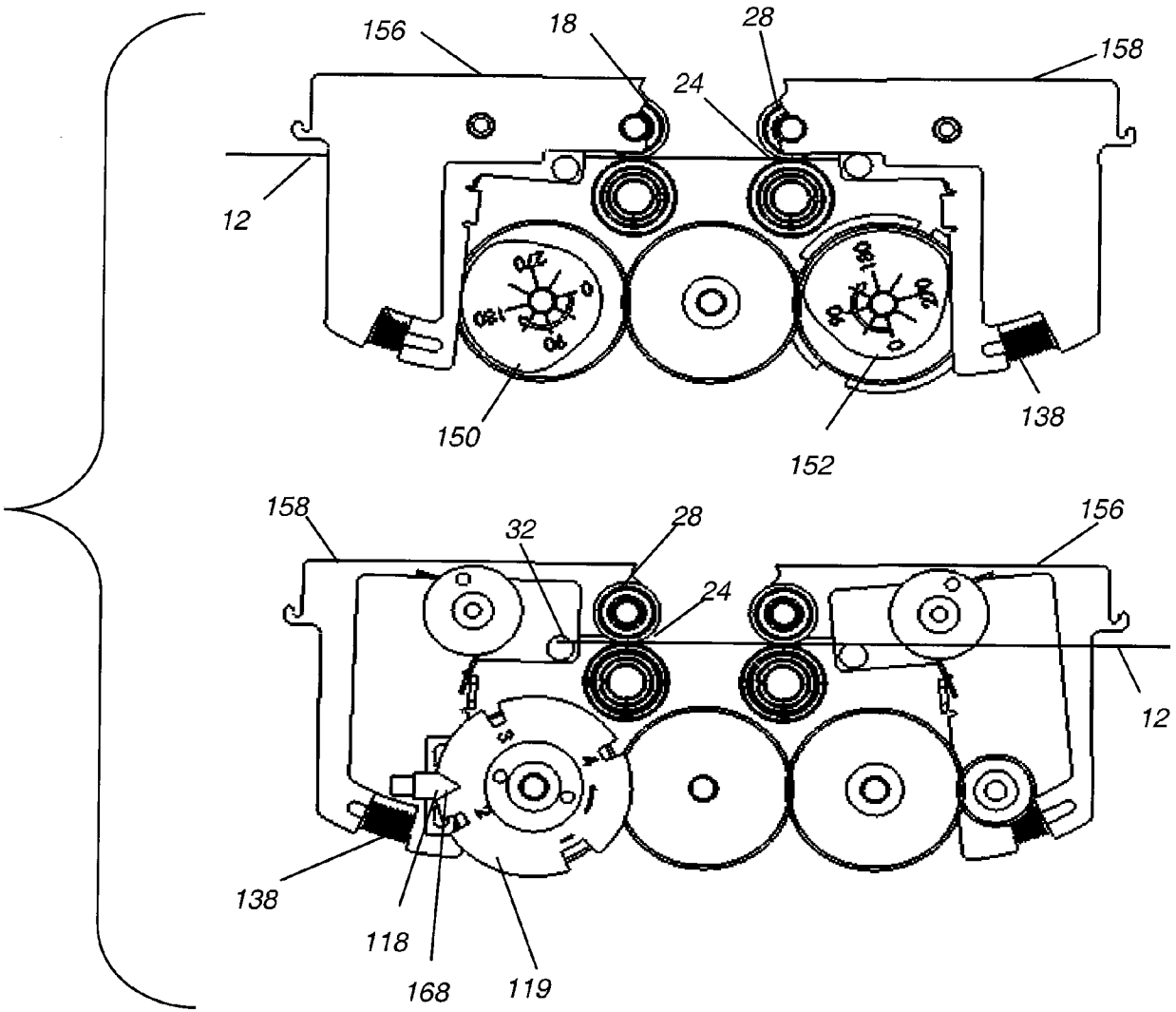

FIG. 7F shows the next phase, as leading edge 32 has passed through exit nip 24. Engagement of exit pressure roller 28 now begins as cams 150, 152 begin to turn and detector wheel 119 moves from position "2". There is, at this point, minimal force exerted on pressure roller 28 as roller link 158 begins to drop pressure roller 28 gently into engagement, thereby forming exit nip 24. Spring 138 is not yet compressed.

Figure 7G:
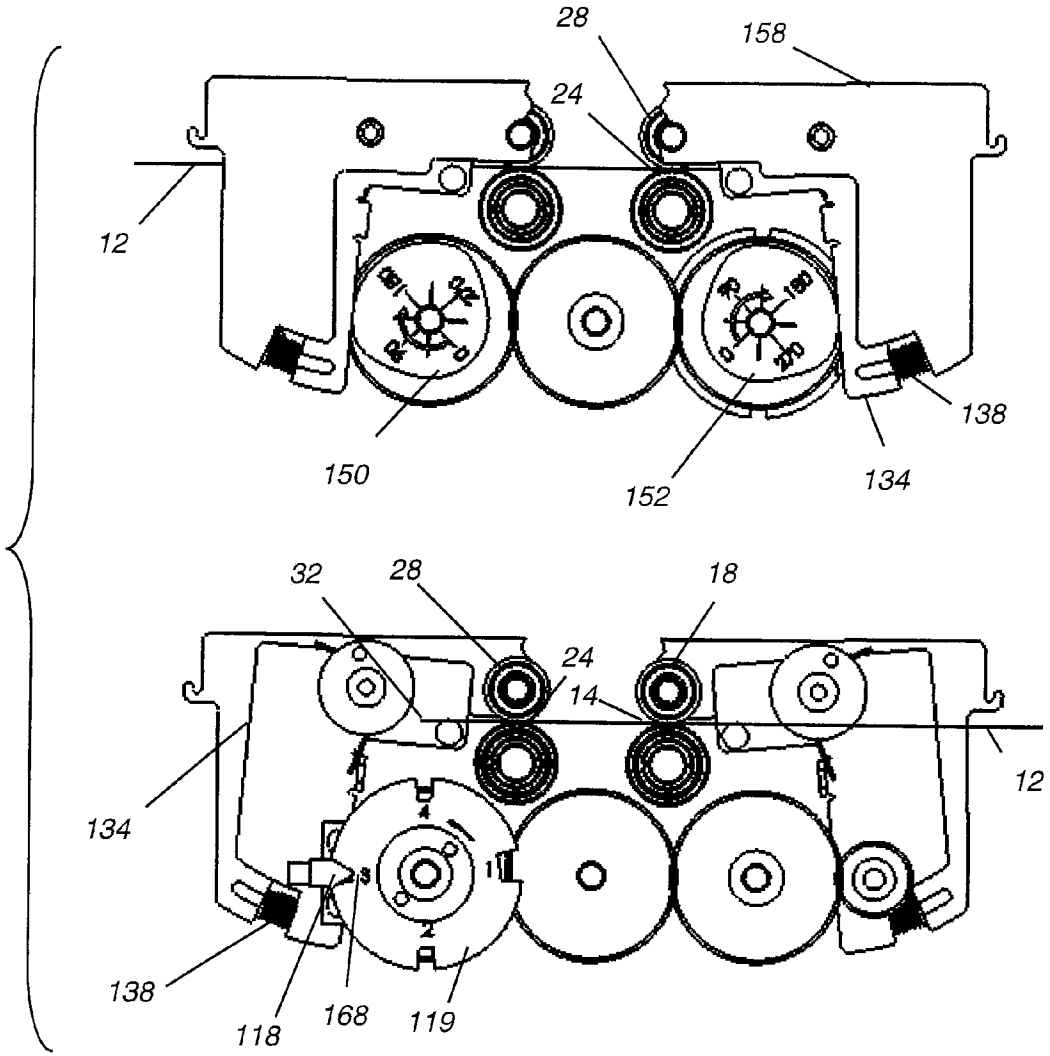

FIG. 7G shows the increase of downward pressure applied to exit nip 24. Spring 138 begins to be compressed, so that continually increasing pressure is applied to engage pressure roller 28. Detector wheel 119 reaches notch 168 numbered "3". At this point, both entrance and exit nips 14 and 24 have full engagement. The bulk of image recording now takes place with both entrance and exit pressure rollers 18 and 28 engaged.

Figure 7H:
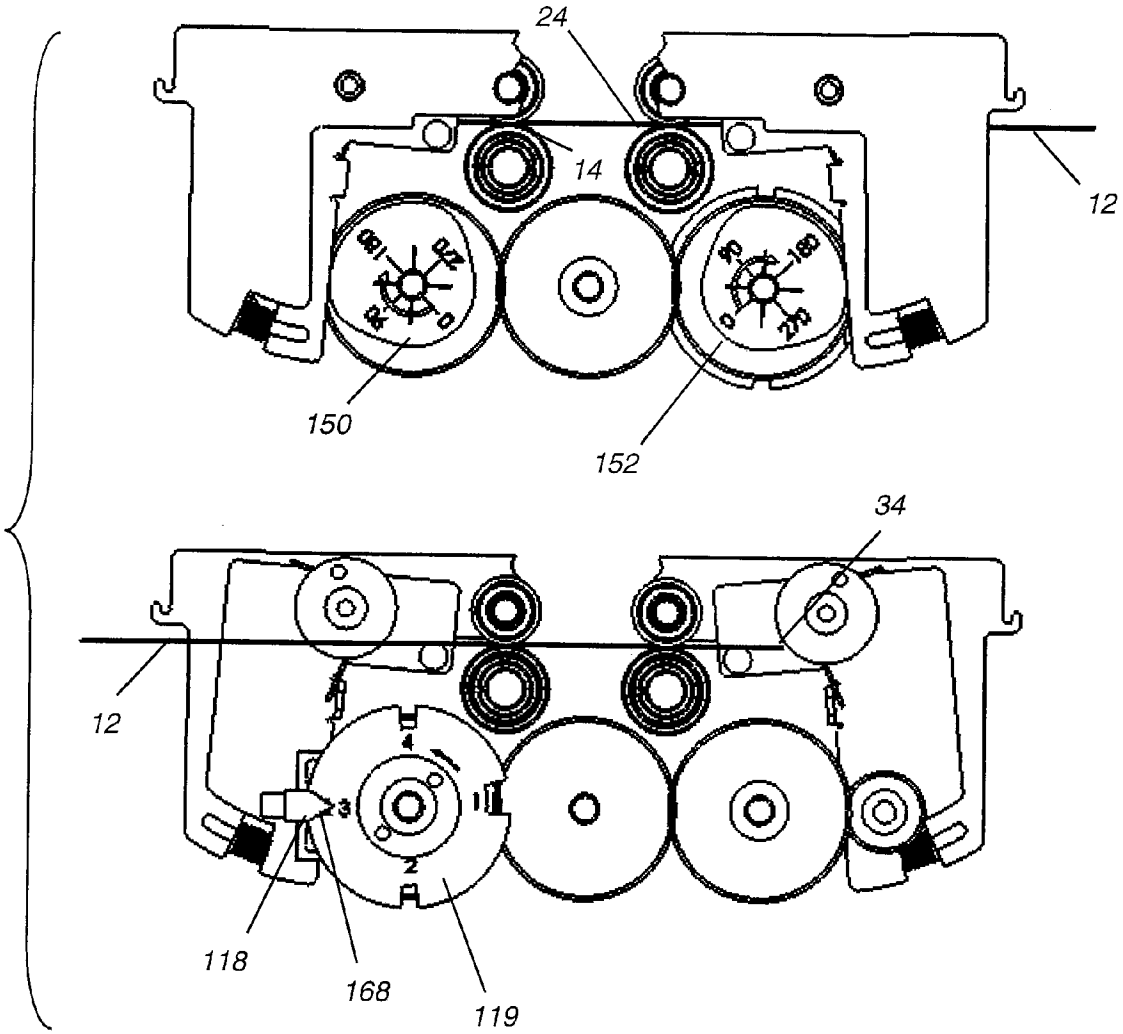

FIG. 7H shows roller position as trailing edge 34 of medium 12 approaches entrance nip 14. Detector wheel 119 remains at notch 168 numbered "3".

Figure 7I:
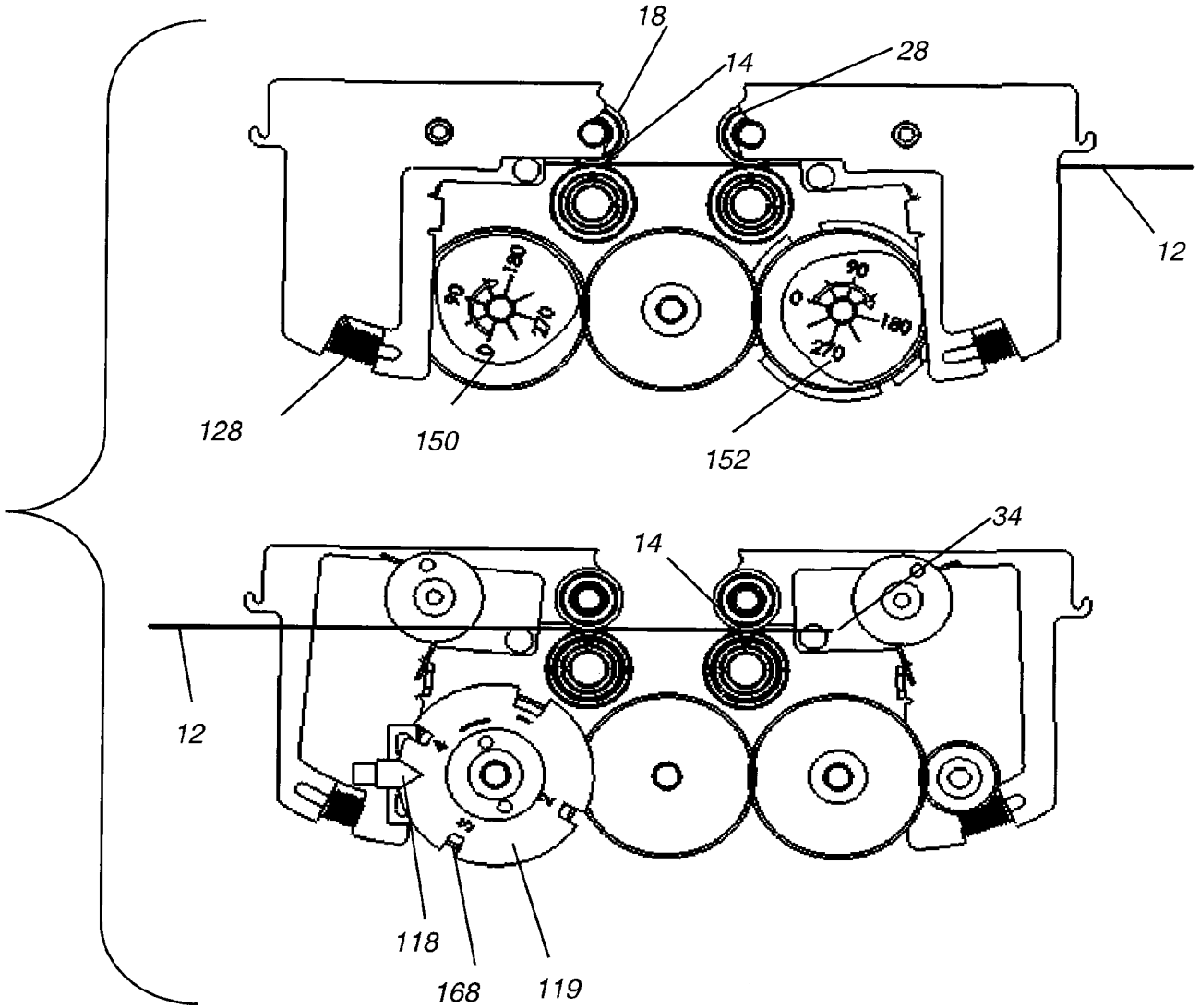

FIG. 7I shows how the "soft liftoff" of entrance roller 18 is effected as trailing edge 34 nears entrance nip 14. Cams 150, 152 are rotated, causing de-compression of spring 128, slowly releasing force at entrance nip 14. Exit roller 28 remains fully engaged. Detector wheel 119 rotates out of the "3" position.

Figure 7J:
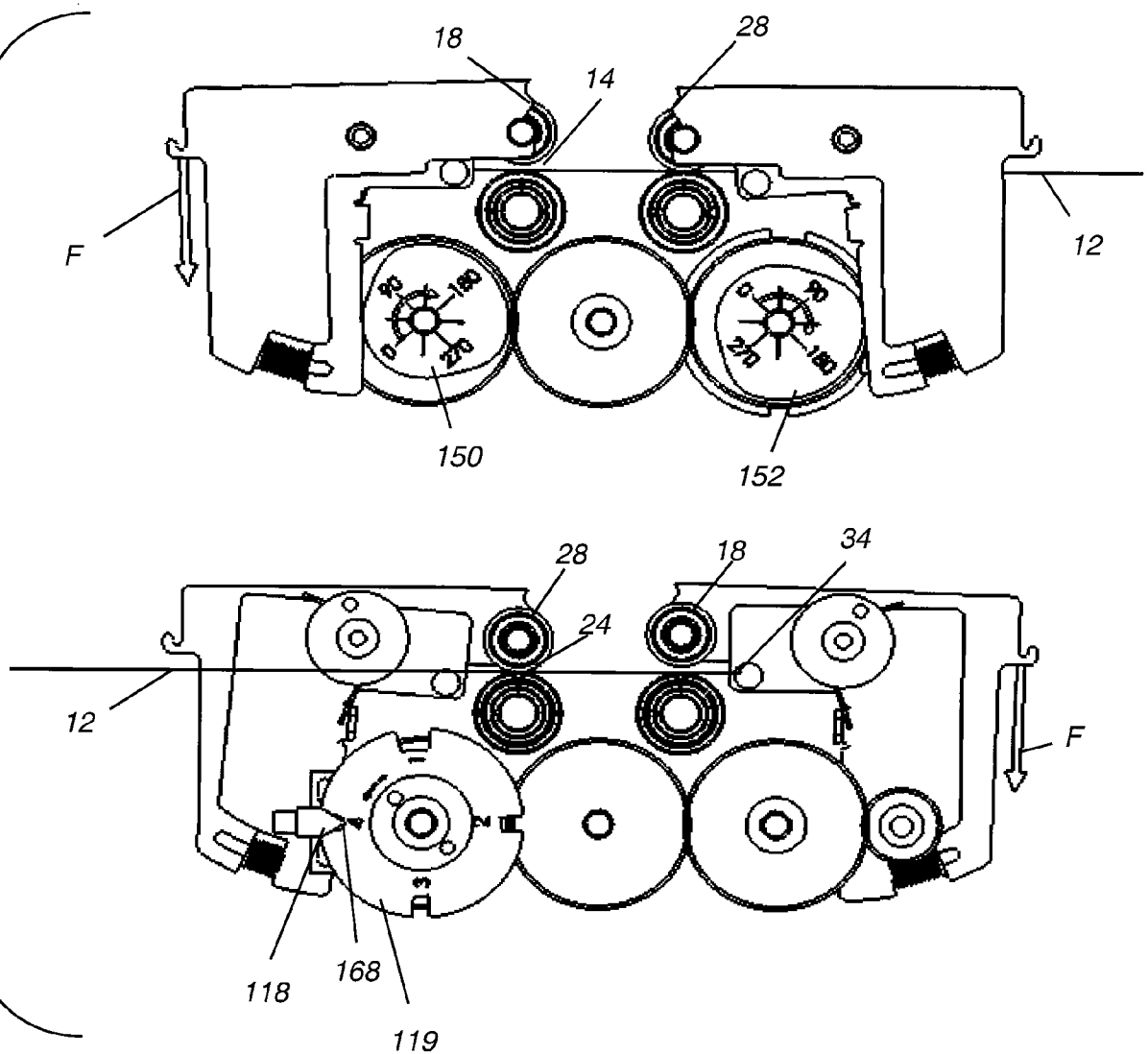

FIG. 7J shows entrance pressure roller 18 raised at entrance nip 14 as trailing edge 34 moves closer to entrance nip 14. Downward force F and upward movement of lifting pin 166 by cam follower link 132 raise entrance pressure roller 18, disengaging it from nip 14. Exit pressure roller 28 remains fully engaged at entrance nip 24. Detector wheel 119 reaches notch 168 numbered "4".

Figure 7K:
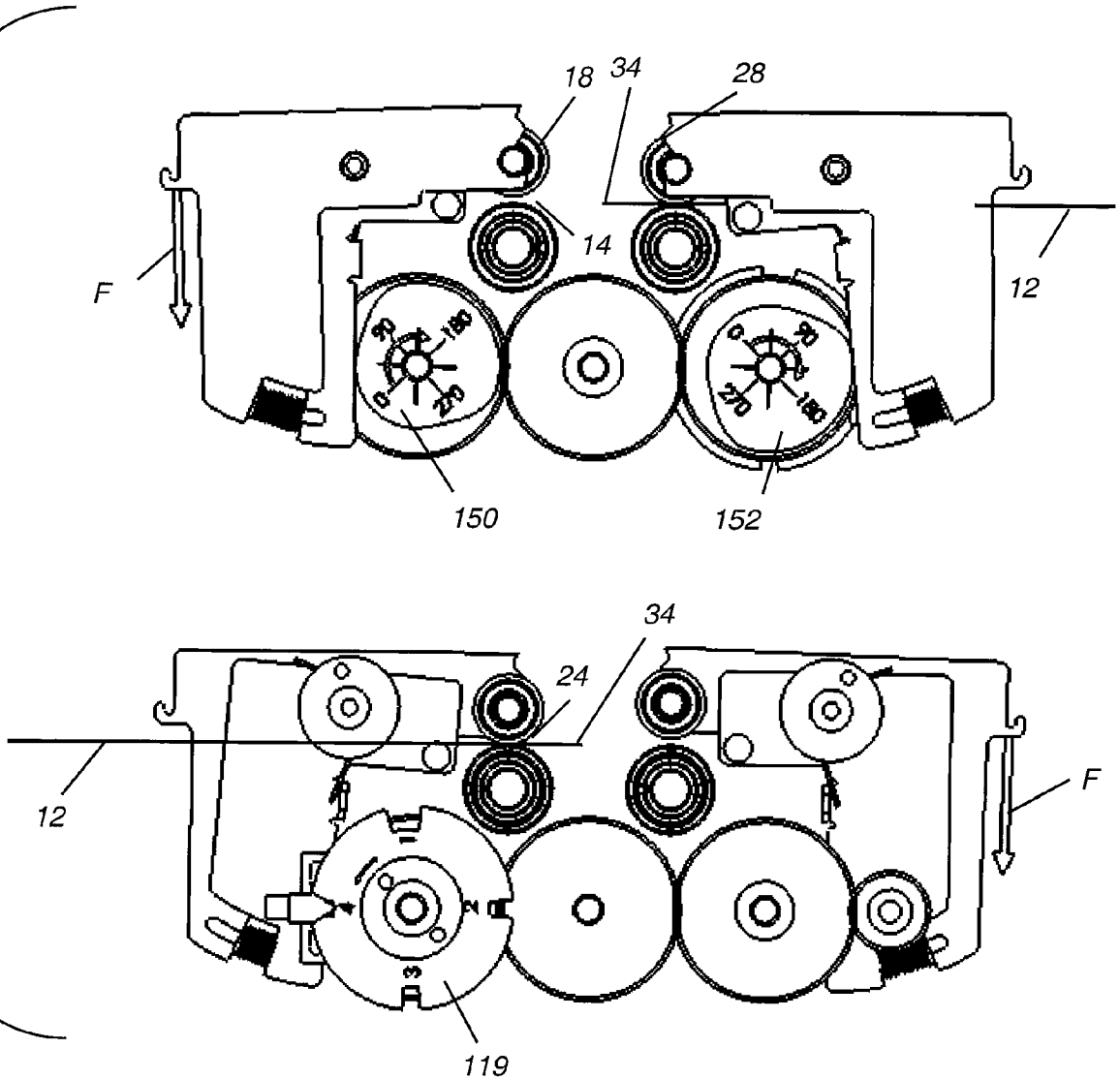

FIG. 7K shows the mechanism as the printing operation nears and reaches completion, with trailing edge 34 of medium 12 beyond disengaged entrance nip 14 and headed toward exit nip 24. Cams 150, 152 are not rotated; detector wheel 119 remains at position "4".

It must be observed that the components shown in FIGS. 6A, 6B, and 7A-7K show one embodiment of dual nip transport apparatus 10 according to the present invention. Other arrangements of components could be used to accomplish the same overall sequence for controlling the transport of recording medium 12 through imaging area 20.

The various embodiments exemplified in FIGS. 4-7K provide cam operated actuation of pressure rollers 18, 28 in dual nip transport apparatus 10. In essence, in the embodiments described herein, pressure rollers 18, 28 are supported at each end by an actuation arm that is moved according to rotating cams and timed according to the position of leading and trailing edges 32 and 34 of medium 12.

Figure 5:
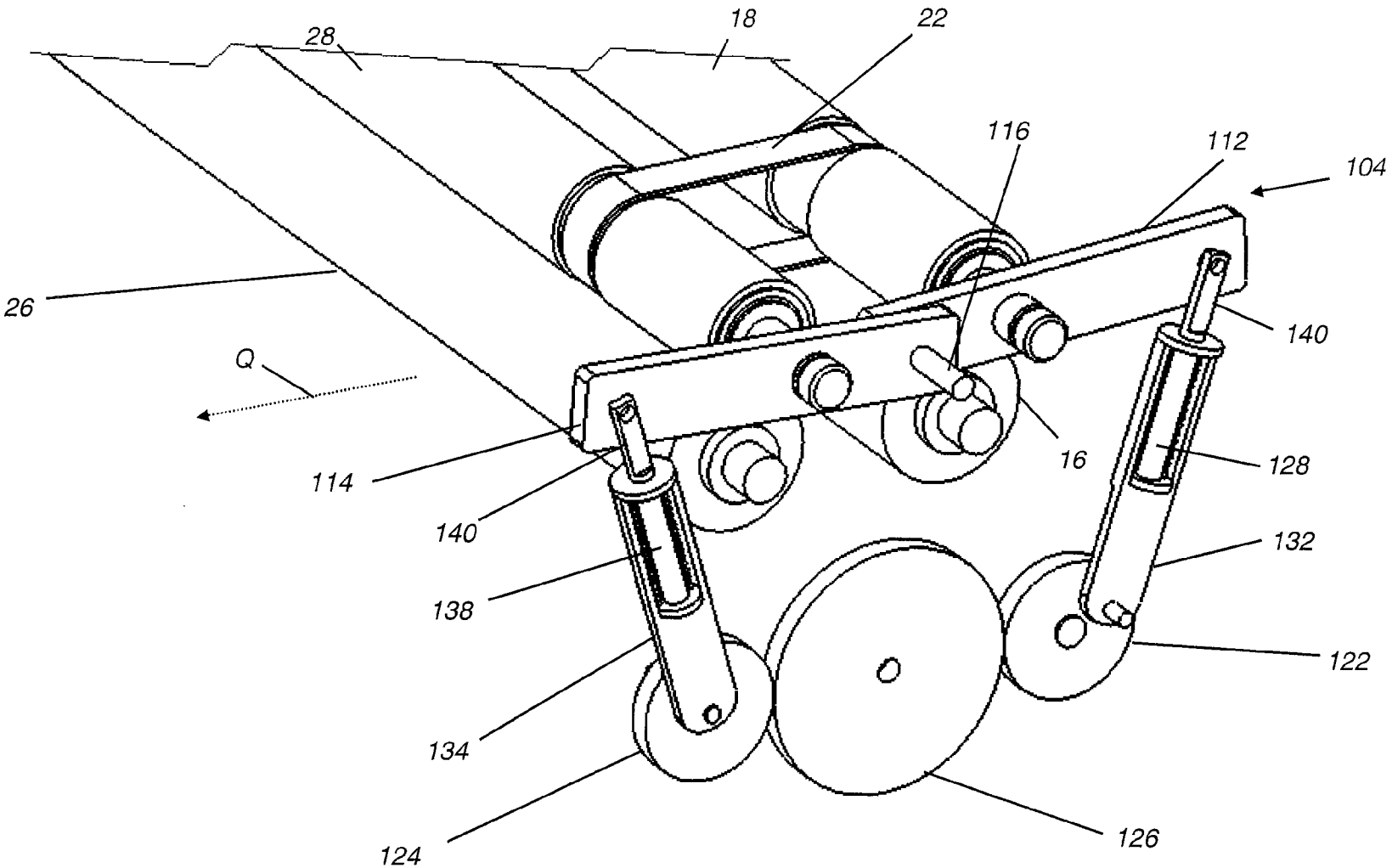
FIG. 5 is a close-up perspective view of components of a dual nip transport apparatus at one end of the rollers in another embodiment.

Referring to FIG. 5, there is shown an alternate embodiment with common components of bracket assembly 104 or 102. Each pressure roller 18, 28 is supported by a corresponding actuation arm 112, 114. A pin 116 provides a common pivot point for actuation arm 112, 114 movement. To move each actuation arm 112, 114, a corresponding eccentric cam 122, 124 is mechanically coupled to a linkage member 132, 134. A coupling gear 126 couples rotation between cams 122, 124. Rotation of each cam 122, 124 causes corresponding changes in linkage member 132, 134 position. Each linkage member 132, 134 is arranged to move its corresponding pressure roller 18, 28 upwards or downwards, with a gradually variable force, from contact against its corresponding entrance or exit roller 16, 26. In the embodiment of FIG. 5, each linkage member 132, 134 has a compression spring 128, 138 that is extended or compressed during portions of cam 122, 124 rotation. Link 132, 134 drives a push rod 140 to provide lifting and lowering, and springs 128, 138 provide a gradually varying nip force after pressure roller 18, 28 contacts corresponding drive roller 16, 26. Using this arrangement, linkage member 132, 134 lifts corresponding actuation arm 112, 114 when spring 128, 138 is uncompressed. Belt 22 maintains rotation of pressure rollers 18, 28 at the same speed. This arrangement is advantageous for providing uniform movement of recording medium 12 through pressure roller actuation assembly 100. Motor 110 and sensor 118 components, not shown in FIG. 5, would be required to provide and sense rotational movement as with the embodiment of FIGS. 6A through 7K.

Timing Chart

Figure 10:
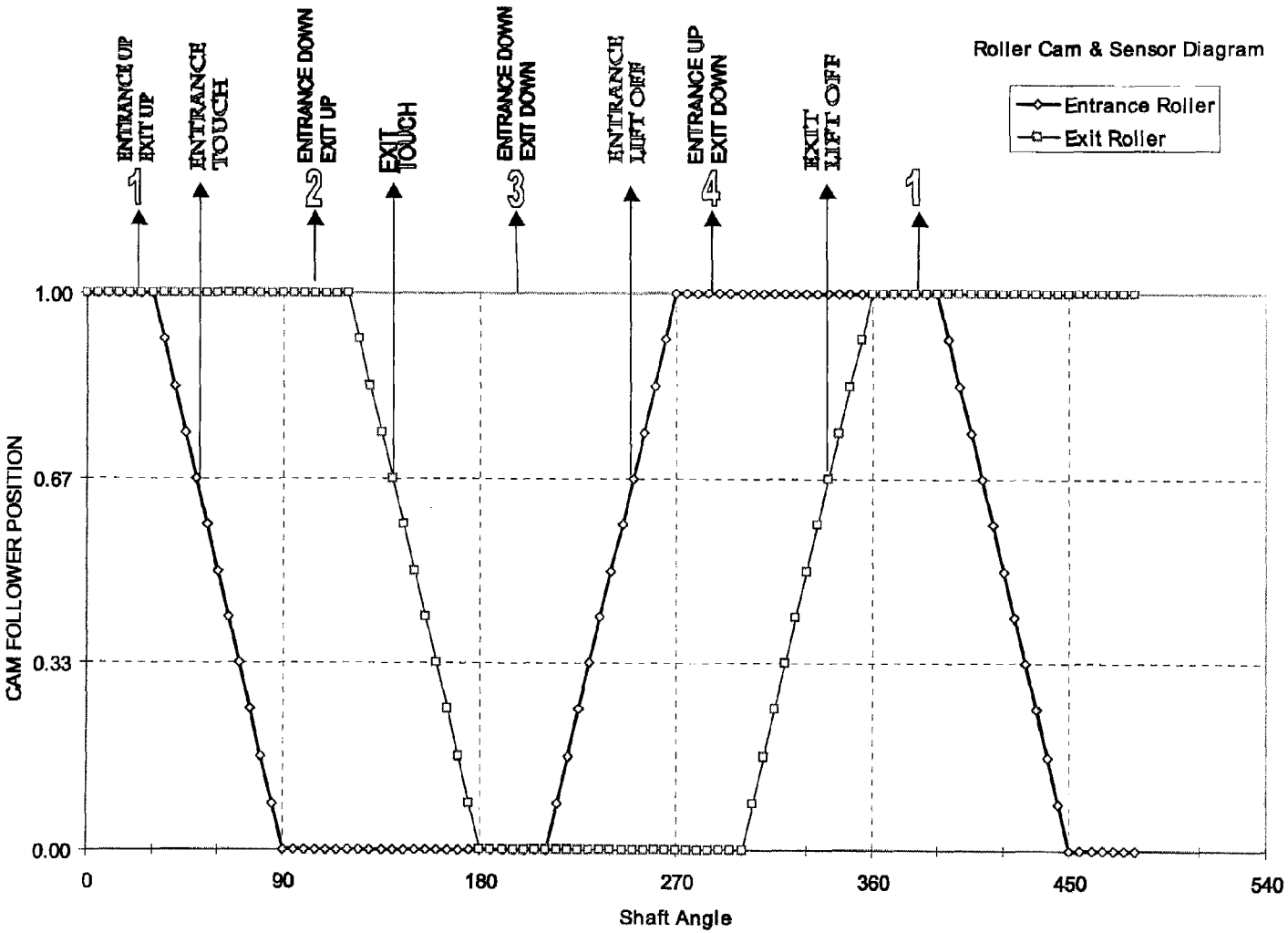
FIG. 10 is a timing diagram showing cam follower position versus shaft angle for the sequence shown in FIGS. 7A-7K.

Referring to FIG. 10, there is shown a timing chart for roller actuation, following the sequence shown in FIGS. 7A-7K. Cam follower position is indicated along the vertical axis, shaft angle along the horizontal. Corresponding notch 168 positions of detector wheel 119, as numbered, are shown above the timing graph. At position of about 0.67, pressure rollers 18, 28 merely touch their corresponding entrance and exit drive rollers 16 and 26, without applied pressure. At values below this level, increasing pressure is applied. At position of 0.00, full pressure is applied at entrance and exit nips 14 and 24.

The invention has been described in detail with particular reference to certain preferred embodiments thereof, but it will be understood that variations and modifications can be effected within the scope of the invention as described above, and as noted in the appended claims, by a person of ordinary skill in the art without departing from the scope of the invention. For example, various arrangements can be used for providing cam-controlled movement, such as loading actuation arms against the cam as cam followers or simply using an eccentric pin as a type of cam. A range of loading components could also be used for providing variable loading force for raising or lowering pressure rollers 18, 28. Pressure rollers 18, 28 and/or their corresponding drive rollers 16, 26 may be segmented into multiple sections spaced along the roller shaft so that nips 14 and/or 24 are formed as segments along the same line, or may be of single-piece roller construction, so that nips 14 and/or 24 are formed as a continuous line.

While the embodiment describes use of dual nip transport apparatus in an image recording apparatus for imaging onto a recording medium such as a photosensitive medium using printhead 56 as a scanned point source, a stationary printhead providing a line of image pixels could alternately be employed. Where a linear printhead 56 provides a line of image pixels, the only scanning motion needed is provided by dual nip transport apparatus 10 itself.

It can be appreciated that dual nip transport apparatus 10 of the present invention could also be employed more broadly in an apparatus that scans and applies a treatment of some type to a sheet medium or conditions the sheet medium in some way, such as applying a layer of material. In addition to the embodiment described above for application of light energy, the dual nip transport apparatus of the present invention could be more broadly employed in an apparatus that scans some other type of electromagnetic energy onto the moving medium. A layer of material could be applied by an ink jet printhead, for example, applying a patterned or continuous coating of an ink or some other substance or substances, so that imaging area 20 (FIG. 2) is, more broadly stated, a treatment section for some scanned treatment process.

The dual nip transport apparatus of the present invention could alternately be used in an apparatus that senses as it scans the medium, such as to obtain encoded data or an image. For such an embodiment, imaging area 20 (FIG. 2)

would serve as a scanning area or scanning section and printhead 56 would be replaced by a scanning component such as a scanned sensor, or a stationary scanning device, for example.

Thus, what is provided is a precision media transport apparatus that uses an actuated pressure roller mechanism for providing controlled nip pressure on the media.

PARTS LIST

10 dual nip transport apparatus
12 recording medium
14 entrance nip
16 entrance drive roller
18 pressure roller
20 imaging area
22 belt
24 exit nip
26 exit drive roller
28 pressure roller
30 dual nip transport apparatus
32 leading edge
34 trailing edge
56 printhead
58 image recording apparatus
60 motor
62 control logic processor
100 pressure roller actuation assembly
102 first bracket assembly
104 second bracket assembly
106 cam shaft
108 cam shaft
110 motor
112 actuation arm
114 actuation arm
116 pin
118 sensor
119 detector wheel
120 actuation arm
122 cam
124 cam
126 coupling gear
128 spring
130 actuation arm
132 cam follower link
134 cam follower link
136 spring
138 spring
140 push rod
142 torsion spring
150 cam
152 cam
156 roller link
158 roller link
160 pivot
162 gear
164 gear
166 link pin
168 notch

The invention claimed is:

1. An apparatus for transporting a sheet medium, comprising:

an entrance drive roller paired with a corresponding entrance pressure roller to form an entrance nip for transporting the sheet medium into a scanning section between the entrance nip and an exit nip;

the exit nip formed by an exit drive roller paired with a corresponding exit pressure roller for transporting the sheet medium out from the scanning section;

wherein, at each end of the entrance pressure roller, an entrance pressure roller actuation arm, actuated by a rotatable entrance roller cam, actuates the entrance pressure roller to exert a variable force against the entrance drive roller; and wherein, at each end of the exit pressure roller, an exit pressure roller actuation arm, actuated by a rotatable exit roller cam, actuates the exit pressure roller to exert a variable force against the exit drive roller, the apparatus further comprising a controller continuously determining a desired entrance nip pressure and a desired exit nip pressure as the sheet medium is transported from the entrance nip to the exit nip, and varying a force applied by at least one of the entrance nip and the exit nip based on the determined desired pressures.

2. The apparatus of claim 1 wherein the scanning section comprises a printhead that applies electromagnetic energy onto the sheet medium.

3. The apparatus of claim 1 wherein the scanning section comprises a printhead that applies a material onto the sheet medium.

4. The apparatus of claim 1 wherein the scanning section comprises a sensor for scanning the surface of the sheet medium.

5. An apparatus for recording an image onto a sheet medium, comprising:

a) an entrance drive roller paired with a corresponding entrance pressure roller to form an entrance nip for transporting the sheet medium into an image recording section;

b) the image recording section comprising a write head for recording onto a portion of the sheet medium being transported between the entrance nip and an exit nip;

c) the exit nip formed by an exit drive roller paired with a corresponding exit pressure roller for transporting the sheet medium out from the image recording section;

wherein, at each end of the entrance pressure roller, an entrance pressure roller actuation arm, actuated by a rotatable entrance roller cam, actuates the entrance pressure roller to exert a variable force against the entrance drive roller; and wherein, at each end of the exit pressure roller, an exit pressure roller actuation arm, actuated by a rotatable exit roller cam, actuates the exit pressure roller to exert a variable force against the exit drive roller, the apparatus further comprising a controller continuously determining a desired entrance nip pressure and a desired exit nip pressure as the sheet medium is transported from the entrance nip to the exit nip, and varying a force applied by at least one of the entrance nip and the exit nip based on the determined desired pressures.

6. The apparatus of claim 5 further comprising a motor for providing rotary motion to the entrance and exit roller cams.

7. The apparatus of claim 5 wherein the entrance pressure roller actuation arm is coupled to the exit pressure roller actuation arm at a pin.

8. The apparatus of claim 5 wherein a belt couples the rotational movement of the entrance pressure roller to the exit pressure roller.

9. The apparatus of claim 5 wherein a spring provides the variable force at the entrance pressure roller actuation arm.

10. The apparatus of claim 5 further comprising a sensor for detecting the position of the entrance roller cam.

11. The apparatus of claim 5 wherein the sheet medium is photosensitive.

12. The apparatus of claim 5 wherein the write head is stationary.

13. The apparatus of claim 5 wherein the write head is scanned.

14. An apparatus for transporting a sheet medium, comprising:

a) an entrance drive roller paired with a corresponding entrance pressure roller to form an entrance nip for transporting the sheet medium into a treatment section;

b) the treatment section conditioning a portion of the sheet medium being transported between the entrance nip and an exit nip;

c) the exit nip formed by an exit drive roller paired with a corresponding exit pressure roller for transporting the sheet medium out from the treatment section;

wherein, at each end of the entrance pressure roller, an entrance pressure roller actuation arm, actuated by a rotatable entrance roller cam, actuates the entrance pressure roller to exert a variable force against the entrance drive roller; and wherein, at each end of the exit pressure roller, an exit pressure roller actuation arm, actuated by a rotatable exit roller cam, actuates the exit pressure roller to exert a variable force against the exit drive roller, the apparatus further comprising a controller continuously determining a desired entrance nip pressure and a desired exit nip pressure as the sheet medium is transported from the entrance nip to the exit nip, and varying a force applied by at least one of the entrance nip and the exit nip based on the determined desired pressures.

15. The apparatus of claim 14 further comprising a motor for providing rotary motion to the entrance and exit roller cams.

16. The apparatus of claim 14 wherein the entrance pressure roller actuation arm is coupled to the exit pressure roller actuation arm at a pin.

17. The apparatus of claim 14 wherein a belt couples the rotational movement of the entrance pressure roller to the exit pressure roller.

18. The apparatus of claim 14 wherein a spring provides the variable force at the entrance pressure roller actuation arm.

19. The apparatus of claim 14 further comprising a sensor for detecting the position of the entrance roller cam.

20. The apparatus of claim 14 wherein the treatment section conditions the portion of the sheet medium by applying a material.

21. The apparatus of claim 14 wherein the treatment section comprises an ink jet printhead.

22. The apparatus of claim 14 wherein the treatment section conditions the portion of the sheet medium by applying electromagnetic energy.

23. A method for transporting a sheet medium, comprising:

a) moving a leading edge of the sheet medium through an entrance nip formed by applying pressure between a first pair of rollers;

b) guiding the leading edge between a second pair of rollers, the second pair of rollers spaced apart until the leading edge has passed between them;

c) moving the second pair of rollers together with gradually increasing pressure to form an exit nip enclosing a portion of the moving sheet medium, such that the medium is fed through both the entrance nip and the exit nip at the same velocity;

d) decreasing pressure at the entrance nip in a gradual manner prior to the arrival of a trailing edge of the medium into the entrance nip and separating the first pair of rollers while maintaining pressure at the exit nip; and e) continuously determining a desired entrance nip pressure and a desired exit nip pressure as the sheet medium is transported from the entrance nip to the exit nip, and varying a force applied by at least one of the entrance nip and the exit nip based on the determined desired pressures.

24. The method of claim 23 wherein the step of moving the second pair of rollers together comprises the step of rotating a cam to actuate an actuation arm coupled to at least one roller in the second pair of rollers.

25. The method of claim 23 further comprising the step of applying electromagnetic energy to a portion of the sheet medium between the entrance nip and the exit nip.

26. The method of claim 23 further comprising the step of applying a material to a portion of the sheet medium between the entrance nip and the exit nip.

27. The method of claim 23 further comprising the step of applying a material, according to a pattern, to a portion of the sheet medium between the entrance nip and the exit nip.

28. The method of claim 23 further comprising the step of scanning a portion of the sheet medium between the entrance nip and the exit nip.

* * * * *